US008866056B2

(12) United States Patent
Shapiro et al.

(10) Patent No.: US 8,866,056 B2
(45) Date of Patent: Oct. 21, 2014

(54) MULTI-COMPONENT PACKAGING SYSTEM AND APPARATUS

(75) Inventors: Catherine M. Shapiro, Omaha, NE (US); Corey L. Berends, Omaha, NE (US); Brian M. Degner, Omaha, NE (US); Jess C. Sweley, Omaha, NE (US); Stephanie L. Bills, Halifax, PA (US); Christopher M. Branda, Lewisburg, PA (US); Kim M. Folta, Omaha, NE (US); Robert Kim, Naperville, IL (US); Sue Lai, Chicago, IL (US); Pamela A. Poulis, Lewisburg, PA (US); Jesse Jay Spungin, Chicago, IL (US); Katie M. Bartholomew, Wheaton, IL (US); Lynda A. Deakin, Oakland, CA (US); Todd T. S. Holscher, Elmhurst, IL (US); Grace J. Hwang, Menlo Park, CA (US); Mark M. Kavanagh, Omaha, NE (US); Michelle S. K. Lee, San Francisco, CA (US); Adam M. Mack, Menlo Park, CA (US); Eleanor D. Morgan, San Francisco, CA (US); John W. Smith, San Francisco, CA (US); David C. Thomsen, San Mateo, CA (US); Gabriel M. Trionfi, San Carlos, CA (US); Ana T. Yuan Chang, Cupertino, CA (US)

(73) Assignee: ConAgra Foods RDM, Inc., Omaha, NE (US)

( * ) Notice: Subject to any disclaimer, the term of this patent is extended or adjusted under 35 U.S.C. 154(b) by 1322 days.

(21) Appl. No.: 12/040,641

(22) Filed: Feb. 29, 2008

(65) Prior Publication Data

US 2008/0210686 A1 Sep. 4, 2008

Related U.S. Application Data

(60) Provisional application No. 60/904,765, filed on Mar. 2, 2007.

(51) Int. Cl.

| | |
|---|---|
| ***H05B 6/80*** | (2006.01) |
| ***B65D 81/34*** | (2006.01) |
| ***B65D 6/02*** | (2006.01) |
| ***B65D 51/16*** | (2006.01) |
| ***B65D 43/02*** | (2006.01) |
| ***B65D 81/32*** | (2006.01) |
| ***B65D 1/36*** | (2006.01) |
| ***B65D 1/34*** | (2006.01) |

(52) U.S. Cl.

CPC .. *B65D 81/3205* (2013.01); *B65D 2543/00611* (2013.01); *B65D 81/3453* (2013.01); *B65D 2543/00296* (2013.01); *B65D 2543/00537* (2013.01); *B65D 2543/00046* (2013.01); *B65D 2205/02* (2013.01); *B65D 2543/00074* (2013.01); *B65D 43/0212* (2013.01); *B65D 2231/025* (2013.01); *B65D 2543/00685* (2013.01); *B65D 2543/0037* (2013.01); *B65D 2543/00731* (2013.01); *B65D 2565/388* (2013.01); *B65D 2543/00796* (2013.01); *B65D 1/36* (2013.01); *B65D 1/34* (2013.01)

USPC ..... 219/735; 426/87; 220/4.27; 220/367.1

(58) Field of Classification Search

CPC ..... B65D 1/34; B65D 1/36; B65D 43/0212; B65D 81/3205; B65D 81/3453; B65D 2565/388; B65D 2205/02; B65D 2231/025; B65D 2543/00046; B65D 2543/00074; B65D 2543/00296

USPC ..... 219/735, 731, 429, 438, 729, 433, 340; 99/495, 339, 401, 445, 385, 412; 126/369; 426/113, 349

See application file for complete search history.

(56) References Cited

U.S. PATENT DOCUMENTS

| | | | | |
|---|---|---|---|---|
| 177,593 | A | 5/1876 | Skelline | 229/193 |
| 241,254 | A | 5/1881 | Udell | 229/198 |

(Continued)

FOREIGN PATENT DOCUMENTS

| | | |
|---|---|---|
| CH | 672 585 | 12/1989 |
| DE | 28 10 175 A1 | 9/1979 |

(Continued)

OTHER PUBLICATIONS

Invitation to Pay Additional Fees with Partial International Search mailed Jun. 25, 2008.

(Continued)

*Primary Examiner* — Quang Van

(74) *Attorney, Agent, or Firm* — Ryan T. Grace; Advent, LLP

(57) ABSTRACT

A multi-component packaging system includes a lower containing assembly, an upper containing assembly, and a cover. The lower containing assembly defines an interior cavity that is adapted to receive a first food component. The upper containing assembly defines an interior that is adapted to receive a second food component. The upper containing assembly is adapted for engagement with the lower containing assembly. The cover is engaged with at least one of the lower containing assembly and the upper containing assembly. The cover includes a passage portion that defines a plurality of apertures.

12 Claims, 30 Drawing Sheets

(56) References Cited

U.S. PATENT DOCUMENTS

| | | | | |
|---|---|---|---|---|
| 254,770 | A | 3/1882 | Hurd | 99/450 |
| 472,002 | A | 3/1892 | Ross | |
| 637,838 | A | 11/1899 | Vernon | 229/194 |
| 902,181 | A | 10/1908 | Tidow | 99/408 |
| 948,198 | A | 2/1910 | Wiegand | 99/417 |
| 952,572 | A | 3/1910 | Meyer | 99/413 |
| 955,033 | A | 4/1910 | Wing | 99/428 |
| 1,004,423 | A | 9/1911 | Hanlon | 220/759 |
| 1,099,603 | A | 6/1914 | Ingersoll | |
| 1,263,004 | A | 4/1918 | Tollagsen | 126/369 |
| 1,341,960 | A | 6/1920 | Meyer et al. | 220/592.23 |
| 1,347,428 | A | 7/1920 | Wittekind | 220/573.4 |
| 1,476,910 | A | 12/1923 | Naugle | |
| 1,519,510 | A | 12/1924 | Santarsiero | 99/416 |
| 1,630,787 | A | 5/1927 | Cullen | 99/416 |
| 1,765,862 | A | 6/1930 | Clapp | |
| 1,864,081 | A | 6/1932 | Marr | 229/104 |
| 1,906,592 | A | 5/1933 | Hiester | |
| 1,944,089 | A | 1/1934 | Litchfield | 150/9 |
| 1,985,978 | A | 5/1934 | Thomas | 426/113 |
| 2,021,465 | A | 11/1935 | Ritscher | 99/403 |
| 2,039,374 | A | 5/1936 | Young | |
| 2,041,227 | A | 5/1936 | Chalmers | 229/87 |
| 2,107,480 | A | 1/1938 | Holton | 126/377.1 |
| 2,149,872 | A | 3/1939 | Schmidt | 229/58 |
| 2,200,977 | A | 5/1940 | Baxter | 426/95 |
| 2,271,921 | A | 2/1942 | Luker | |
| 2,290,396 | A | 7/1942 | Webster | |
| 2,540,036 | A | 1/1951 | Spencer | |
| 2,556,115 | A | 6/1951 | Smith | 99/417 |
| 2,559,101 | A | 7/1951 | Wool | |
| 2,576,862 | A | 11/1951 | Smith et al. | |
| 2,591,578 | A | 4/1952 | McNealy et al. | |
| 2,600,566 | A | 6/1952 | Moffett | |
| 2,650,485 | A | 9/1953 | La Greca | 220/23.83 |
| 2,660,529 | A | 11/1953 | Bloom | |
| 2,667,422 | A | 1/1954 | Kauffman | |
| 2,673,805 | A | 3/1954 | Colman | 99/171 |
| 2,673,806 | A | 3/1954 | Colman | 99/171 |
| 2,714,070 | A | 7/1955 | Welch | |
| 2,741,559 | A | 4/1956 | Banowitz | 99/171 |
| 2,777,769 | A | 1/1957 | Morris Hodges Hiram | 426/113 |
| 2,801,930 | A | 8/1957 | Paulucci | 99/193 |
| 2,805,392 | A | 9/1957 | Schnoll | 324/706 |
| 2,852,898 | A | 9/1958 | Berg | 53/182 |
| 2,858,970 | A | 11/1958 | Barnes et al. | 229/55 |
| 2,865,768 | A | 12/1958 | Barnes et al. | 99/171 |
| D185,399 | S | 6/1959 | Tupper | |
| 2,960,218 | A | 11/1960 | Cheeley | |
| 2,961,520 | A | 11/1960 | Long | |
| 2,965,501 | A | 12/1960 | Harriss | 426/120 |
| 3,012,895 | A | 12/1961 | Stelnicki | |
| 3,027,261 | A | 3/1962 | Samara | 99/171 |
| 3,035,754 | A | 5/1962 | Meister | 229/53 |
| 3,052,554 | A | 9/1962 | Colman | 99/171 |
| 3,068,779 | A | 12/1962 | Eidlisz | 99/416 |
| 3,070,275 | A | 12/1962 | Bostrom | 229/4.5 |
| 3,107,989 | A | 10/1963 | Fesco | 55/381 |
| 3,109,359 | A | 11/1963 | Falla | 99/339 |
| 3,141,400 | A | 7/1964 | Powers | |
| 3,179,036 | A | 4/1965 | Luker | |
| 3,191,520 | A | 6/1965 | Halter | |
| 3,219,460 | A | 11/1965 | Brown | |
| 3,220,635 | A | 11/1965 | Kasting et al. | 229/57 |
| 3,220,856 | A | 11/1965 | Vischer | |
| 3,240,610 | A | 3/1966 | Cease | |
| 3,244,537 | A | 4/1966 | Cease | |
| 3,246,446 | A | 4/1966 | Powers | |
| 3,262,668 | A | 7/1966 | Luker | |
| 3,271,169 | A | 9/1966 | Baker et al. | |
| 3,286,832 | A | 11/1966 | Pilger | 206/56 |
| 3,287,140 | A | 11/1966 | Brussell | |
| 3,293,048 | A | 12/1966 | Kitterman | 99/171 |
| 3,326,097 | A | 6/1967 | Lokey | 93/82 |
| 3,349,941 | A | 10/1967 | Wanderer | 220/23.88 |
| 3,353,327 | A | 11/1967 | Cutler et al. | 53/28 |
| 3,353,707 | A | 11/1967 | Eyles | |
| 3,357,152 | A | 12/1967 | Geigel | 53/29 |
| 3,396,868 | A | 8/1968 | Fitzgerald | 206/508 |
| 3,420,397 | A | 1/1969 | Miller | 220/203.09 |
| 3,421,654 | A | 1/1969 | Hexel | |
| 3,424,342 | A | 1/1969 | Scopp et al. | 220/793 |
| 3,445,050 | A | 5/1969 | Peters et al. | |
| 3,447,714 | A | 6/1969 | Elliot | 206/1.5 |
| 3,489,075 | A | 1/1970 | O'Reilly | 99/450 |
| 3,521,788 | A | 7/1970 | Carter et al. | |
| 3,547,661 | A | 12/1970 | Stevenson | |
| 3,608,770 | A | 9/1971 | Naimoli | 220/16 |
| 3,610,135 | A | 10/1971 | Sheridan | |
| 3,610,458 | A | 10/1971 | Nissley | |
| 3,615,646 | A | 10/1971 | Neely et al. | |
| 3,620,834 | A | 11/1971 | Duffy | 117/213 |
| 3,637,132 | A | 1/1972 | Gray | 229/53 |
| 3,638,784 | A | 2/1972 | Bodolay et al. | 206/45.34 |
| 3,641,926 | A | 2/1972 | Williams et al. | 99/448 |
| 3,647,508 | A | 3/1972 | Gorrell | 117/38 |
| 3,669,688 | A | 6/1972 | Thompson | |
| 3,718,480 | A | 2/1973 | Tremblay et al. | |
| 3,741,427 | A * | 6/1973 | Doyle | 220/573.4 |
| 3,777,447 | A | 12/1973 | Herbine et al. | 53/36 |
| 3,811,374 | A | 5/1974 | Mann | |
| 3,835,280 | A | 9/1974 | Gades et al. | 219/10.55 |
| 3,836,042 | A | 9/1974 | Petitto | |
| 3,844,409 | A | 10/1974 | Bodolay et al. | 206/45.34 |
| 3,851,574 | A | 12/1974 | Katz et al. | 426/107 |
| 3,865,301 | A | 2/1975 | Pothier et al. | |
| 3,873,735 | A | 3/1975 | Chalin et al. | 426/87 |
| 3,881,027 | A | 4/1975 | Levinson | |
| 3,884,213 | A | 5/1975 | Smith | |
| 3,884,383 | A | 5/1975 | Burch et al. | |
| 3,893,567 | A | 7/1975 | Davis et al. | 206/520 |
| 3,908,029 | A | 9/1975 | Fredrickson | |
| 3,938,730 | A | 2/1976 | Detzel et al. | 229/120.01 |
| 3,941,967 | A | 3/1976 | Sumi et al. | |
| 3,956,866 | A | 5/1976 | Lattur | 53/29 |
| 3,965,323 | A | 6/1976 | Forker, Jr. et al. | |
| 3,970,241 | A | 7/1976 | Hanson | 229/58 |
| 3,973,045 | A | 8/1976 | Brandberg et al. | 426/110 |
| 3,974,353 | A | 8/1976 | Goltsos | |
| 3,975,552 | A | 8/1976 | Stangroom | |
| 3,983,256 | A | 9/1976 | Norris et al. | |
| 3,985,990 | A | 10/1976 | Levinson | |
| 4,018,355 | A | 4/1977 | Ando | |
| 4,031,261 | A | 6/1977 | Durst | |
| 4,036,423 | A | 7/1977 | Gordon | 229/43 |
| 4,038,425 | A | 7/1977 | Brandberg et al. | 426/107 |
| 4,043,098 | A | 8/1977 | Putnam, Jr. et al. | 53/180 M |
| 4,065,583 | A | 12/1977 | Ahlgren | |
| 4,077,853 | A | 3/1978 | Coll-Palagos | 204/20 |
| 4,079,853 | A | 3/1978 | Casult | 229/101 |
| 4,082,184 | A | 4/1978 | Hammer | 206/519 |
| 4,082,691 | A | 4/1978 | Berger | |
| 4,096,948 | A | 6/1978 | Kuchenbecker | |
| 4,113,095 | A | 9/1978 | Dietz et al. | |
| 4,118,913 | A | 10/1978 | Putnam, Jr. et al. | 53/551 |
| 4,126,945 | A | 11/1978 | Manser et al. | |
| 4,132,811 | A | 1/1979 | Standing et al. | 426/111 |
| 4,133,896 | A | 1/1979 | Standing et al. | |
| 4,136,505 | A | 1/1979 | Putnam, Jr. et al. | 53/551 |
| 4,138,054 | A | 2/1979 | Spencer | 229/23 BT |
| 4,140,889 | A | 2/1979 | Mason et al. | 219/733 |
| 4,154,860 | A | 5/1979 | Daswick | |
| 4,156,806 | A | 5/1979 | Teich et al. | 219/10.55 E |
| 4,164,174 | A | 8/1979 | Wallsten | 99/415 |
| 4,171,605 | A | 10/1979 | Putnam, Jr. et al. | 53/552 |
| 4,184,061 | A | 1/1980 | Suzuki et al. | 219/10.55 E |
| 4,186,217 | A | 1/1980 | Tchack | |
| 4,190,757 | A | 2/1980 | Turpin et al. | 219/10.55 E |
| 4,196,331 | A | 4/1980 | Leveckis et al. | 219/10.55 E |
| D255,751 | S | 7/1980 | Daenen | D7/667 |
| 4,219,573 | A | 8/1980 | Borek | 426/107 |
| 4,228,945 | A | 10/1980 | Wysocki | |
| 4,230,767 | A | 10/1980 | Isaka et al. | 428/349 |
| 4,230,924 | A | 10/1980 | Brastad et al. | 219/10.55 E |

(56) References Cited

U.S. PATENT DOCUMENTS 4,233,325 A 11/1980 Slangan et al.
4,241,563 A 12/1980 Müller et al. ..... 53/511
4,242,378 A 12/1980 Arai ..... 427/264
4,258,086 A 3/1981 Beall ..... 219/10.43
4,264,668 A 4/1981 Balla ..... 428/195
4,267,420 A 5/1981 Brastad ..... 219/10.55 E
4,279,933 A 7/1981 Austin et al. ..... 426/124
4,280,032 A 7/1981 Levinson
4,283,427 A 8/1981 Winters et al. ..... 426/107
4,291,520 A 9/1981 Prince et al. ..... 53/551
4,292,332 A 9/1981 McHam ..... 426/111
4,304,352 A 12/1981 Humphries ..... 229/31 R
4,306,133 A 12/1981 Levinson
4,316,070 A 2/1982 Prosise et al. ..... 219/10.55 E
4,317,017 A 2/1982 Bowen
4,324,088 A 4/1982 Yamashita et al. ..... 53/527
4,328,254 A 5/1982 Waldburger
4,335,291 A 6/1982 Ishino et al. ..... 219/10.55 E
4,340,138 A 7/1982 Bernhardt ..... 206/216
4,345,133 A 8/1982 Cherney et al. ..... 219/10.55 E
4,348,421 A 9/1982 Sakakibara et al.
4,351,997 A 9/1982 Mattisson et al.
4,355,757 A 10/1982 Roccaforte ..... 229/33
4,373,511 A 2/1983 Miles et al. ..... 126/369
4,377,493 A 3/1983 Boylan et al.
4,389,438 A 6/1983 Ohtsuki et al. ..... 428/35
4,390,555 A 6/1983 Levinson
4,398,994 A 8/1983 Beckett ..... 156/659.1
4,416,906 A 11/1983 Watkins
4,425,368 A 1/1984 Watkins
4,439,656 A 3/1984 Peleg
4,453,665 A 6/1984 Roccaforte et al. ..... 229/41 B
4,461,031 A 7/1984 Blamer ..... 383/123
4,477,705 A 10/1984 Danley et al.
4,478,349 A 10/1984 Haverland et al. ..... 220/573.4
4,481,392 A 11/1984 Nibbe et al.
4,486,640 A 12/1984 Bowen et al.
4,493,685 A 1/1985 Blamer ..... 493/235
4,496,815 A 1/1985 Jorgensen
4,517,045 A 5/1985 Beckett ..... 156/345
4,518,651 A 5/1985 Wolfe, Jr. ..... 428/308.8
4,529,089 A 7/1985 Gasbarra et al. ..... 206/525
4,532,397 A 7/1985 McClelland
D280,058 S 8/1985 Carlson ..... D7/629
4,535,889 A * 8/1985 Terauds ..... 206/527
4,552,614 A 11/1985 Beckett ..... 156/640
4,553,010 A 11/1985 Bohrer et al. ..... 219/10.55 E
4,571,337 A 2/1986 Cage et al. ..... 426/107
4,581,989 A 4/1986 Swartley ..... 99/346
4,584,202 A 4/1986 Roccaforte ..... 426/111
4,586,649 A 5/1986 Webinger ..... 229/114
4,610,755 A 9/1986 Beckett ..... 156/634
4,612,431 A 9/1986 Brown et al. ..... 219/10.55 E
4,626,352 A 12/1986 Massey et al. ..... 210/469
4,640,838 A 2/1987 Isakson et al. ..... 426/107
4,641,005 A 2/1987 Seiferth ..... 219/10.55 E
4,648,549 A 3/1987 Trutna ..... 229/143
4,657,141 A 4/1987 Sorensen ..... 206/519
4,661,326 A * 4/1987 Schainholz ..... 422/310
4,661,671 A 4/1987 Maroszek ..... 219/10.55 E
4,661,672 A 4/1987 Nakanaga
4,677,905 A 7/1987 Johnson ..... 99/413
4,678,882 A 7/1987 Bohrer et al. ..... 219/10.55 E
D291,522 S 8/1987 Daenen et al. ..... D7/667
4,685,997 A 8/1987 Beckett ..... 156/629
4,697,703 A 10/1987 Will ..... 206/438
4,701,585 A 10/1987 Stewart ..... 219/10.55 E
4,703,148 A 10/1987 Mikulski et al.
4,703,149 A 10/1987 Sugisawa et al.
4,705,927 A 11/1987 Levendusky et al. .. 219/10.55 E
4,713,510 A 12/1987 Quick et al. ..... 219/10.55 E
4,714,012 A 12/1987 Hernandez ..... 99/444
4,727,706 A 3/1988 Beer ..... 53/434
4,734,288 A 3/1988 Engstrom et al. ..... 426/107
4,738,882 A 4/1988 Rayford et al. ..... 428/35
4,739,698 A 4/1988 Allaire ..... 99/410
4,739,898 A * 4/1988 Brown ..... 220/203.21
4,745,249 A 5/1988 Daniels
4,777,053 A 10/1988 Tobelmann et al.
4,794,005 A 12/1988 Swiontek
4,797,010 A 1/1989 Coelho ..... 383/109
4,803,088 A 2/1989 Yamamoto et al.
4,804,582 A 2/1989 Noding et al. ..... 428/332
4,806,718 A 2/1989 Seaborne et al. ..... 219/10.55 E
4,808,780 A 2/1989 Seaborne ..... 219/10.55 E
4,810,845 A 3/1989 Seaborne ..... 219/10.55 E
4,818,831 A 4/1989 Seaborne ..... 219/10.55 E
4,825,025 A 4/1989 Seiferth ..... 219/10.55 E
4,842,876 A 6/1989 Anderson et al.
4,846,350 A 7/1989 Sorensen ..... 206/520
4,848,579 A 7/1989 Barnes et al.
4,851,246 A 7/1989 Maxwell et al. ..... 426/107
4,853,505 A 8/1989 Sorenson
4,853,509 A 8/1989 Murakami
4,864,089 A 9/1989 Tighe et al. ..... 219/10.55 E
4,864,090 A 9/1989 Maxwell et al. ..... 219/10.55 E
4,866,041 A 9/1989 Lemieux et al.
4,870,233 A 9/1989 McDonald et al.
4,873,919 A 10/1989 Janssen
4,883,936 A 11/1989 Maynard et al. ..... 219/10.55 E
4,892,744 A 1/1990 Ylvisaker ..... 426/111
4,896,009 A 1/1990 Pawlowski ..... 219/10.55 E
4,899,925 A 2/1990 Bowden et al.
4,904,488 A 2/1990 LaBaw et al. ..... 426/107
4,914,266 A 4/1990 Parks et al. ..... 219/10.55 E
4,915,216 A 4/1990 Magers ..... 206/520
4,915,780 A 4/1990 Beckett ..... 156/661.1
4,920,251 A 4/1990 Whitenack et al.
4,922,079 A 5/1990 Bowen et al.
4,923,704 A * 5/1990 Levinson ..... 426/243
4,924,048 A 5/1990 Bunce et al.
4,935,592 A 6/1990 Oppenheimer
4,939,332 A 7/1990 Hahn
4,943,456 A 7/1990 Pollart et al. ..... 428/34.3
4,948,932 A 8/1990 Clough ..... 219/10.55 E
4,952,765 A 8/1990 Toyosawa
4,959,516 A 9/1990 Tighe et al. ..... 219/10.55 E
4,960,598 A 10/1990 Swiontek
4,961,944 A 10/1990 Matoba et al.
4,963,708 A 10/1990 Kearns et al.
D312,189 S 11/1990 Noel
4,973,502 A 11/1990 Holzmüller
4,973,810 A 11/1990 Brauner ..... 219/10.55 E
4,982,064 A 1/1991 Hartman et al. ..... 219/10.55 E
4,987,280 A 1/1991 Kanafani et al.
4,990,349 A 2/1991 Chawan et al.
4,992,638 A 2/1991 Hewitt et al.
5,011,299 A 4/1991 Black, Jr. et al. ..... 383/126
5,025,715 A 6/1991 Sir
5,026,958 A 6/1991 Palacios
5,035,800 A 7/1991 Kopach ..... 210/469
5,038,009 A 8/1991 Babbitt ..... 219/10.55 E
5,039,001 A 8/1991 Kinigakis et al. ..... 229/120
5,041,295 A 8/1991 Perry et al.
5,044,777 A 9/1991 Watkins et al. ..... 383/100
5,050,791 A 9/1991 Bowden et al.
5,052,369 A 10/1991 Johnson
5,057,331 A 10/1991 Levinson
D321,302 S 11/1991 Zimmerman
5,063,072 A 11/1991 Gillmore et al.
5,075,526 A 12/1991 Sklenak et al.
5,077,066 A 12/1991 Mattson et al.
5,081,330 A 1/1992 Brandberg et al. .... 219/10.55 E
5,094,865 A 3/1992 Levinson
5,095,186 A 3/1992 Scott Russell et al. 219/10.55 E
5,106,635 A 4/1992 McCutchan et al.
5,107,087 A 4/1992 Yamada et al.
5,108,768 A 4/1992 So
5,153,402 A 10/1992 Quick et al. ..... 219/10.55 E
5,176,284 A 1/1993 Sorensen
5,189,947 A 3/1993 Yim ..... 426/109
5,190,777 A 3/1993 Anderson et al.
5,195,829 A 3/1993 Watkins et al. ..... 383/100
5,200,590 A 4/1993 Bowen et al. ..... 219/10.55 E

(56) References Cited

U.S. PATENT DOCUMENTS

D335,445 S 5/1993 Detert et al. ..... D9/761
D335,821 S 5/1993 Detert et al. ..... D9/761
D336,242 S 6/1993 Detert et al. ..... D9/761
5,223,291 A 6/1993 Levinson et al.
5,230,914 A 7/1993 Akervik
5,241,149 A 8/1993 Watanabe et al.
D341,990 S 12/1993 Yim ..... D7/354
5,294,765 A 3/1994 Archibald et al. ..... 219/727
5,298,708 A 3/1994 Babu et al. ..... 219/728
5,300,747 A 4/1994 Simon
5,315,083 A 5/1994 Green
5,363,750 A 11/1994 Miller et al. ..... 99/426
D353,303 S 12/1994 Davis
5,370,042 A 12/1994 Tolchin et al.
5,419,451 A 5/1995 Bitel, Jr. ..... 220/306
5,423,453 A 6/1995 Fritz
5,520,301 A 5/1996 Sohn ..... 220/265
D370,598 S 6/1996 Koch
D371,963 S 7/1996 Ahem, Jr.
5,540,381 A 7/1996 Davis ..... 229/103.2
5,558,798 A 9/1996 Tsai
D376,512 S 12/1996 Klemme ..... D7/538
5,588,587 A 12/1996 Stier et al.
D378,565 S 3/1997 Cousins ..... D7/667
D378,566 S 3/1997 Cousins ..... D7/667
5,645,300 A 7/1997 Hill
5,645,762 A 7/1997 Cook et al.
5,650,084 A 7/1997 Bley ..... 219/727
D384,555 S 10/1997 Bradley
5,674,546 A 10/1997 Barnes et al.
D386,042 S 11/1997 Miller
5,690,853 A 11/1997 Jackson et al. ..... 219/727
5,695,801 A 12/1997 Oh
5,698,306 A 12/1997 Prosise et al.
5,704,485 A 1/1998 Cautereels et al. ..... 206/546
5,718,933 A 2/1998 Fultz ..... 426/115
D391,440 S 3/1998 Cousins ..... D7/360
5,726,426 A 3/1998 Davis et al.
5,741,534 A 4/1998 Chung
5,747,086 A 5/1998 Bows et al.
5,753,895 A 5/1998 Olson et al. ..... 219/727
5,770,840 A 6/1998 Lorence
5,807,597 A 9/1998 Barnes et al.
D405,561 S 2/1999 Willinger et al. ..... D30/129
5,869,120 A 2/1999 Blazevich ..... 426/132
5,871,790 A 2/1999 Monier et al. ..... 426/107
5,876,811 A 3/1999 Blackwell et al.
5,900,264 A 5/1999 Gics
5,913,966 A 6/1999 Arnone et al. ..... 99/413
5,916,470 A 6/1999 Besser et al.
5,916,620 A 6/1999 Oh
5,925,281 A 7/1999 Levinson
5,928,554 A 7/1999 Olson et al. ..... 219/727
5,931,333 A 8/1999 Woodnorth et al. ..... 220/573.4
5,961,872 A 10/1999 Simon et al.
5,970,858 A 10/1999 Boehm et al. ..... 99/446
5,974,953 A 11/1999 Messerli ..... 99/340
5,986,248 A 11/1999 Matsuno et al. ..... 219/728
5,988,045 A 11/1999 Housley
5,988,050 A 11/1999 Foster, Jr. ..... 99/467
D418,017 S 12/1999 Henry
D419,371 S 1/2000 Haley ..... D7/392.1
6,018,157 A 1/2000 Craft
6,042,856 A 3/2000 Sagan et al. ..... 426/87
D422,176 S 4/2000 Laib
6,049,072 A 4/2000 Olson et al. ..... 219/727
6,085,930 A 7/2000 Curtis ..... 220/371
6,097,017 A 8/2000 Pickford
6,103,291 A 8/2000 Fernandez Tapia ..... 426/523
6,106,882 A 8/2000 Oh et al.
D432,414 S 10/2000 Simpson et al. ..... D9/711
D432,914 S 10/2000 Hayes et al.
6,126,976 A 10/2000 Hasse, Jr. et al.
6,136,355 A 10/2000 Fukuyama
D433,884 S 11/2000 Fujimoto ..... D7/667
6,147,337 A 11/2000 Besser
6,150,646 A 11/2000 Lai et al.
6,168,044 B1 1/2001 Zettle et al.
6,175,105 B1 1/2001 Rubbright et al.
6,180,148 B1 1/2001 Yajima
6,180,150 B1 1/2001 Schäfer
6,183,789 B1 2/2001 Nilsson et al.
6,187,354 B1 2/2001 Hopkins
6,192,792 B1 2/2001 Gremillion
6,196,406 B1 3/2001 Ennis
6,217,918 B1 4/2001 Oh et al.
D441,597 S 5/2001 Wyche
D442,425 S 5/2001 Wyche
6,229,131 B1 5/2001 Koochaki
6,230,919 B1 5/2001 Guillin ..... 220/315
D445,633 S 7/2001 Bradley
D449,102 S 10/2001 Shin ..... D23/366
D449,495 S 10/2001 Tucker et al.
6,309,684 B2 10/2001 Hopkins, Sr.
6,394,337 B1 5/2002 Ross et al. ..... 229/103.2
6,396,036 B1 5/2002 Hanson ..... 219/727
6,422,453 B1 7/2002 Wang ..... 229/114
6,455,084 B2 9/2002 Johns
6,463,844 B1 10/2002 Wang et al.
6,467,399 B1 10/2002 Boutte
6,486,455 B1 11/2002 Merabet
D466,762 S 12/2002 Cote et al. ..... D7/545
6,509,047 B2 1/2003 Edomwonyi
D470,768 S 2/2003 Melhede ..... D9/428
6,559,431 B2 5/2003 Hopkins
6,565,910 B1 5/2003 Schell et al. ..... 426/589
D477,187 S 7/2003 McCallister et al.
6,608,292 B1 8/2003 Barnes
6,612,482 B2 9/2003 Ross ..... 229/103.2
6,645,539 B2 11/2003 Bukowski et al.
D483,616 S 12/2003 Thonis ..... D7/545
D485,473 S 1/2004 Dais et al. ..... D7/629
6,727,484 B2 4/2004 Policappelli
6,803,551 B2 * 10/2004 Kim et al. ..... 219/731
D497,774 S 11/2004 Smith et al. ..... D7/543
6,818,873 B2 11/2004 Savage et al.
6,840,159 B1 1/2005 Li ..... 99/337
D502,847 S 3/2005 Leonori ..... D7/667
6,868,980 B2 * 3/2005 Schultz et al. ..... 220/367.1
D505,048 S 5/2005 Cornfield ..... D7/409
D505,590 S 5/2005 Greiner et al. ..... D7/409
D508,822 S 8/2005 Smith et al.
D513,942 S 1/2006 De Groote ..... D7/665
7,008,214 B2 3/2006 Faddi ..... 425/382 R
7,022,359 B2 4/2006 Montserrate Gibernau
7,025,213 B2 4/2006 Chen ..... 210/474
D521,380 S 5/2006 Jackson et al.
7,038,181 B2 5/2006 Edmark
7,045,190 B2 5/2006 Inagaki et al.
D526,840 S 8/2006 Carlson ..... D7/392.1
7,090,090 B2 8/2006 Ohyama
D529,797 S 10/2006 Wilcox et al. ..... D9/428
D543,796 S 6/2007 Lion et al. ..... D7/667
D552,433 S 10/2007 Stewart ..... D7/667
D557,982 S 12/2007 Ablo et al. ..... D7/409
D558,536 S 1/2008 Curtin ..... D7/667
D558,602 S 1/2008 Kissner et al. ..... D9/711
D563,157 S 3/2008 Bouveret et al.
D564,287 S 3/2008 Bouveret et al.
D564,307 S 3/2008 Repp ..... D7/667
D571,656 S 6/2008 Maslowski ..... D9/425
D577,295 S 9/2008 Miller et al. ..... D9/711
D582,201 S 12/2008 Kellermann et al. ..... D7/360
D582,791 S 12/2008 Elmerhaus ..... D9/721
7,468,498 B2 12/2008 Tuszkiewicz et al. ..... 219/725
D584,111 S 1/2009 Eide et al. ..... D7/667
D584,145 S 1/2009 Young
D590,663 S 4/2009 Simon et al.
D591,591 S 5/2009 Moecks et al.
D592,948 S 5/2009 Mayer ..... D9/418
D593,369 S 6/2009 Green et al. ..... D7/602
D594,328 S 6/2009 Shapiro et al. ..... D9/435
D598,717 S 8/2009 Jalet ..... D7/667
D607,095 S 12/2009 LeMay et al. ..... D23/366

(56) References Cited

U.S. PATENT DOCUMENTS

| | | | | |
|---|---|---|---|---|
| D610,903 | S | 3/2010 | Shapiro et al. | D9/428 |
| D611,300 | S | 3/2010 | Chen et al. | D7/409 |
| D612,196 | S | 3/2010 | Furlong | D7/392.1 |
| D613,131 | S | 4/2010 | Chen et al. | D5/667 |
| D630,061 | S | 1/2011 | Kellermann et al. | D7/545 |
| D630,507 | S | 1/2011 | Short et al. | D9/427 |
| D630,940 | S | 1/2011 | Shapiro et al. | D9/428 |
| D632,561 | S | 2/2011 | Short et al. | D9/427 |
| D633,810 | S | 3/2011 | Jenkins | D9/721 |
| 7,977,612 | B2 | 7/2011 | Levy et al. | 219/729 |
| 8,302,528 | B2 | 11/2012 | Pawlick et al. | 99/448 |
| 2001/0035402 | A1 | 11/2001 | Barrow | 219/432 |
| 2001/0043971 | A1 | 11/2001 | Johns | |
| 2001/0050002 | A1 | 12/2001 | Bonanno | |
| 2002/0096450 | A1 | 7/2002 | Garst | 206/516 |
| 2002/0110622 | A1 | 8/2002 | Lloyd et al. | 426/115 |
| 2003/0003200 | A1 | 1/2003 | Bukowski et al. | |
| 2003/0068411 | A1 | 4/2003 | McCallister | 426/107 |
| 2003/0167932 | A1 | 9/2003 | Chen | |
| 2003/0213718 | A1 | 11/2003 | Ducharme et al. | |
| 2004/0058038 | A1 | 3/2004 | Lee | |
| 2004/0107637 | A1 | 6/2004 | Sieverding | 47/83 |
| 2004/0121049 | A1 | 6/2004 | Ebner et al. | |
| 2004/0164075 | A1 | 8/2004 | Henze et al. | |
| 2004/0216620 | A1 | 11/2004 | Quiggins et al. | |
| 2004/0238438 | A1 | 12/2004 | Chen | 210/474 |
| 2005/0040161 | A1 | 2/2005 | Lin et al. | |
| 2005/0051549 | A1 | 3/2005 | Nelson | 220/23.83 |
| 2005/0069602 | A1 | 3/2005 | Faddi | 425/208 |
| 2005/0079250 | A1 | 4/2005 | Mao et al. | 426/113 |
| 2005/0079252 | A1 | 4/2005 | Kendig et al. | 426/125 |
| 2005/0082305 | A1 | 4/2005 | Dais et al. | |
| 2005/0092762 | A1 | 5/2005 | Murat et al. | |
| 2005/0109772 | A1 | 5/2005 | Thorpe et al. | |
| 2005/0112243 | A1 | 5/2005 | Bellmann | 426/106 |
| 2005/0115417 | A1 | 6/2005 | Murat et al. | 99/413 |
| 2005/0208182 | A1 | 9/2005 | Gilbert et al. | 426/87 |
| 2005/0220939 | A1 | 10/2005 | Morrow | 426/86 |
| 2005/0229793 | A1 | 10/2005 | Wengrovsky | 99/483 |
| 2005/0256060 | A1 | 11/2005 | Hilgers et al. | 514/25 |
| 2005/0271776 | A1 | 12/2005 | Siegel | 426/138 |
| 2005/0281921 | A1 | 12/2005 | Langston et al. | |
| 2006/0013929 | A1 | 1/2006 | Morris et al. | |
| 2006/0088678 | A1 | 4/2006 | Berrier et al. | |
| 2006/0110498 | A1 | 5/2006 | Dellinger et al. | |
| 2006/0118552 | A1 | 6/2006 | Tiefenback | |
| 2006/0121168 | A1* | 6/2006 | Flaherty et al. | 426/557 |
| 2006/0151339 | A1 | 7/2006 | Bradley et al. | |
| 2006/0236593 | A1 | 10/2006 | Cap | |
| 2006/0260598 | A1 | 11/2006 | Bjork et al. | |
| 2006/0289522 | A1 | 12/2006 | Middleton et al. | 219/730 |
| 2007/0029314 | A1 | 2/2007 | Rodgers et al. | |
| 2007/0059406 | A1 | 3/2007 | Shahsavarani | 426/106 |
| 2007/0090103 | A1 | 4/2007 | France et al. | |
| 2007/0116806 | A1 | 5/2007 | Parsons | |
| 2007/0116807 | A1 | 5/2007 | Parsons | |
| 2007/0131679 | A1 | 6/2007 | Edwards et al. | |
| 2007/0181008 | A1 | 8/2007 | Pawlick et al. | |
| 2007/0251874 | A1 | 11/2007 | Stewart | 210/232 |
| 2008/0069485 | A1 | 3/2008 | France et al. | |
| 2008/0138473 | A1 | 6/2008 | Pawlick et al. | |
| 2008/0178744 | A1 | 7/2008 | Hill | 99/323.5 |
| 2009/0022858 | A1 | 1/2009 | Pawlick | |
| 2009/0035433 | A1 | 2/2009 | France et al. | |
| 2009/0078125 | A1 | 3/2009 | Pawlick et al. | |
| 2009/0142455 | A1 | 6/2009 | Parsons | 426/120 |
| 2010/0015293 | A1 | 1/2010 | Shapiro | |

FOREIGN PATENT DOCUMENTS

| | | | |
|---|---|---|---|
| EP | 0326105 | A1 | 8/1989 |
| EP | 0 449 643 | A1 | 10/1991 |
| EP | 1 245 504 | A1 | 10/2002 |
| EP | 1 352 841 | A1 | 10/2003 |
| EP | 1 352 848 | A1 | 10/2003 |
| EP | 1 514 804 | A1 | 3/2005 |
| EP | 1 464 262 | B1 | 7/2005 |
| EP | 1 612 150 | A1 | 1/2006 |
| EP | 1 749 757 | A2 | 2/2007 |
| FR | 2 631 315 | A3 | 11/1989 |
| FR | 2 774 262 | A1 | 8/1999 |
| FR | 2 846 196 | A1 | 4/2004 |
| FR | 2 860 213 | | 4/2005 |
| FR | 2 929 491 | | 10/2009 |
| GB | 1 560 488 | | 2/1980 |
| GB | 2 218 962 | A | 11/1989 |
| GB | 2 295 371 | A | 5/1996 |
| GB | 2 308 465 | A | 6/1997 |
| GB | 2 340 823 | A | 3/2000 |
| JP | 2-109882 | | 4/1990 |
| JP | 4367476 | A | 12/1992 |
| JP | 06293366 | | 10/1994 |
| JP | 09051767 | | 2/1997 |
| JP | 10094370 | A | 4/1998 |
| JP | 10-129742 | | 5/1998 |
| JP | 11113511 | | 4/1999 |
| JP | 2001348074 | A | 12/2001 |
| JP | 2005059863 | A | 3/2005 |
| JP | A-2005-312923 | | 11/2005 |
| JP | A-2006-34645 | | 2/2006 |
| JP | 2010-189031 | | 9/2010 |
| MX | 01011879 | A | 6/2002 |
| WO | WO 86/00275 | | 1/1986 |
| WO | WO 96/07604 | | 3/1996 |
| WO | WO 98/33399 | | 8/1998 |
| WO | WO 99/59897 | | 11/1999 |
| WO | WO 02/051716 | | 7/2002 |
| WO | WO 03/086882 | A1 | 10/2003 |
| WO | WO 2004/045970 | A1 | 6/2004 |
| WO | WO 2006/098950 | A2 | 9/2006 |
| WO | WO 2006/128156 | A2 | 11/2006 |
| WO | WO 2006/136825 | A1 | 12/2006 |
| WO | WO 2007/003864 | A2 | 1/2007 |
| WO | WO 2008/109448 | A2 | 9/2008 |
| WO | WO 2008/109448 | A3 | 9/2008 |
| WO | WO 2009/097030 | A1 | 8/2009 |
| WO | WO 2009/136038 | A1 | 11/2009 |

OTHER PUBLICATIONS

International Search Report and Written Opinion mailed Aug. 20, 2008.

U.S. Official Action mailed Jul. 15, 2011, in U.S. Appl. No. 11/423,259.

European Search Report dated Jan. 27, 2011, in Application No. 08832921.4-1261.

Supp. International Search Report dated Mar. 15, 2011, Application No. PCT/CA2006/001894.

U.S. Appl. No. 29/351,253, filed Dec. 2, 2009 entitled "Container Assembly".

Certified priority document in U.S. Appl. No. 12/012,403, filed Feb. 2, 2008 (filed in Int'l Application No. PCT/US2008/080874 on Nov. 3, 2008).

http://www.unclebens.de/produkte/heiss_auf_reis/heiss_auf_reis_uebersicht.aspx, Mars Inc., 2006, 1 pg.

http://www.pastanmoresale.com, site accessed Jun. 15, 2010, 2 pgs.

U.S. Official Action Mailed Mar. 29, 2010 in U.S. Appl. No. 29/351,253.

European Office Action mailed Jul. 15, 2010 in Application No. 08731136.1.

U.S. Official Action Mailed Dec. 11, 2008 in U.S. Appl. No. 11/286,008.

U.S. Official Action Mailed May 25, 2010 in U.S. Appl. No. 11/423,259.

U.S. Official Action Mailed Oct. 6, 2010 in U.S. Appl. No. 11/424,520.

U.S. Official Action Mailed Nov. 10, 2010 in U.S. Appl. No. 11/423,259.

U.S. Official Action mailed Nov. 7, 2011, in U.S. Appl. No. 11/890,297.

(56) References Cited

OTHER PUBLICATIONS

U.S. Official Action mailed Dec. 20, 2011, in U.S. Appl. No. 11/423,259.
U.S. Official Action mailed Jan. 11, 2012, in U.S. Appl. No. 11/703,066.
U.S. Official Action mailed Jan. 19, 2012, in U.S. Appl. No. 11/286,008.
U.S. Official Action mailed Jan. 25, 2012, in U.S. Appl. No. 11/903,732.
Starmaid Microwave Steamer Jun. 26, 2006, [on-line], retrieved on Oct. 13, 2011. Retrieved from the internet: URL:<http://www.flickr.com/photos/starmaid/5180282532/>.
Progressive International Mini Steamer (on line), Jul. 18, 2006. Retrieved from the Internet at the URL listed in the column immediately following this column.
http://www.google.com/search?q=microwave+steamer&hl=en&biw=1291&bih=10158aa=X8ei=0ZuXTtqGMkOtugGMyolHWBA&vedw0CAkOpwUoBg&sourcewInt&themod%8A1%2Cod...min%3A%2Cod...max%3AB%2F2%2F2007&tbm..#pg..microwave+ateamer&hi=en&sugexp=geih&cp=12&gs_id=9&xhr=t&q=microwave+mini+steamer&pf=p&sclient=psy-ab&biw=1291&bih=1015&tbs=img:1%2Cod_max%3AB%2F2%2F20068.
Mini Steamer—Progressive International / Starmaid vegetable steamer, [on line], retrieved Oct. 21, 2011, Retreived from the Internet: URL:<http://www.camoingcookwarepro.com/Progressive_International_Microwave_Mini_Steamer>.
Tupperware India, Cook easy Microsteamer, The Hindu Business Line, [on line], Jun. 26, 2003, retrieved on Oct. 21, 2011, Retrieved from the Internet: URL:<http://www.thehindubusinessline.in/catalyst/2003/06/26/stories/2003062600070406.htm>.
Microwave mini steamer, Lunch in a Box, [on line]Feb. 12, 2007, Retrieved from the Internet: URL:<http://www.flickr.com/photos/24506652@N00/388209604/>.
Microwave steamer 2, Oct. 16, 2006, [on line], Retrieved from the Internet: URL:<http://www.flickr.com/photos/momsinmind/271170248/>.
U.S. Official Action Mailed Dec. 9, 2010 in U.S. Appl. No. 29/346,147.
U.S. Official Action Mailed Dec. 9, 2010 in U.S. Appl. No. 29/346,148.
U.S. Official Action Mailed Dec. 28, 2010 in U.S. Appl. No. 29/364,804.
U.S. Official Action Mailed Feb. 23, 2010 in U.S. Appl. No. 29/369,419.
U.S. Official Action Mailed Mar. 21, 2011 in U.S. Appl. No. 11/703,066.
U.S. Official Action mailed Mar. 26, 2012, in U.S. Appl. No. 11/424,520.
U.S. Official Action Mailed Apr. 1, 2011 in U.S. Appl. No. 11/424,520.
U.S. Official Action Mailed Apr. 6, 2011 in U.S. Appl. No. 12/277,886.
U.S. Official Action Mailed Apr. 8, 2011 in U.S. Appl. No. 29/369,416.
U.S. Official Action Mailed Apr. 12, 2011 in U.S. Appl. No. 29/369,423.
"Cafe Steamers," HealthyChoice.com, http://www.healthychoice.com/products/meals/cafe_steamers.jsp (Retrieved Aug. 2007).
"Ziploc® Containers With Snap'n'Seal Lids: Designed With You in Mind," brochure found at http://www.ziploc.com/food-storage-containers/, 2 pages (Retrieved Nov. 14, 2005).
"Ziploc® Containers With Snap'n'Seal Lids: Storage Made Simpler!," brochure found at http://www.ziploc.com/new_containers.html, 1 page (Retrieved Nov. 14, 2005).
Anchor Hocking '70 Catalog, p. 83, baking dishes at #4, 5 and 6 (Oct. 1970).
France, "Steam Cooking Apparatus," U.S. Appl. No. 60/728,468, filed Oct. 20, 2005.
McCallister, "Microwaveable Pasta Product," U.S. Appl. No. 09/965,300, filed Sep. 28, 2001.
Photographs of a food tray available from Inter Frost GmbH at a trade show in Germany, Oct. 2005.
European Allowance dated Jul. 18, 2011, in Application No. 10163678.5-2308.
U.S. Official Action mailed Aug. 5, 2011, in U.S. Appl. No. 11/286,008.
U.S. Official Action mailed Aug. 9, 2011, in U.S. Appl. No. 11/903,732.
U.S. Official Action mailed Aug. 11, 2011, in U.S. Appl. No. 11/703,066.
U.S. Appl. No. 29/346,147, filed Oct. 27, 2009 entitled "Container Assembly".
U.S. Appl. No. 29/346,148, filed Oct. 27, 2009 entitled Container Basket.
U.S. Appl. No. 29/364,804, filed Jun. 29, 2010 entitled "Container Assembly".
U.S. Appl. No. 29/364,807, filed Jun. 29, 2010 entitled "Container Basket".
Machine translation FR 2774262, Etimble et al., Aug. 1999, 9 pgs.
International Search Report dated Aug. 20, 2008, Application No. PCT/US2008/055512.
U.S. Official Action Mailed Sep. 18, 2008 in U.S. Appl. No. 11/424,520.
U.S. Official Action Mailed Apr. 24, 2009 in U.S. Appl. No. 11/286,008.
U.S. Official Action Mailed Apr. 30, 2009 in U.S. Appl. No. 11/424,520.
U.S. Official Action Mailed Oct. 16, 2009 in U.S. Appl. No. 11/903,732.
U.S. Official Action Mailed Oct. 29, 2009 in U.S. Appl. No. 11/890,297.
U.S. Official Action Mailed Nov. 12, 2009 in U.S. Appl. No. 11/286,008.
U.S. Official Action Mailed Nov. 25, 2009 in U.S. Appl. No. 11/424,520.
U.S. Official Action Mailed Mar. 10, 2010 in U.S. Appl. No. 11/903,732.
U.S. Official Action Mailed Apr. 14, 2010 in U.S. Appl. No. 11/424,520.
U.S. Official Action Mailed May 21, 2010 in U.S. Appl. No. 11/286,008.
U.S. Official Action Mailed Oct. 7, 2010 in U.S. Appl. No. 11/703,066.
U.S. Official Action mailed May 2, 2012, in U.S. Appl. No. 11/903,732.
U.S. Official Action mailed Jul. 3, 2013, in U.S. Appl. No. 11/286,008.
U.S. Official Action mailed Aug. 21, 2013, in U.S. Appl. No. 11/890,297.
"Propylene Glycol Monostearate"; *Hawley's Condensed Chemical Dictionary Thirteenth Edition;* 1997.
U.S. Official Action mailed Jan. 24, 2013, in U.S. Appl. No. 12/471,114.
U.S. Official Action mailed Sep. 10, 2012, in U.S. Appl. No. 11/903,732.
U.S. Official Action mailed Sep. 24, 2012, in U.S. Appl. No. 12/471,114.
U.S. Official Action mailed Nov. 30, 2012, in U.S. Appl. No. 29/424,416.
Succinylated Monoglycerides; http://www.fao.org/ag/agn/jecfa-additives/specs/Monograph1/Additive-443.pdf; 1982; obtained Sep. 14, 2012.
U.S. Official Action mailed Oct. 3, 2013, in U.S. Appl. No. 11/703,066.
U.S. Official Action mailed Sep. 27, 2013, in U.S. Appl. No. 11/423,259.
U.S. Official Action mailed Sep. 19, 2013, in U.S. Appl. No. 12/471,114.
U.S. Official Action Mailed Jan. 16, 2014, in U.S. Appl. No. 12/277,886.

(56) References Cited

OTHER PUBLICATIONS

U.S. Official Action Mailed Jan. 16, 2014, in U.S. Appl. No. 11/286,008.
U.S. Official Action Mailed Jan. 22, 2014, in U.S. Appl. No. 12/471,114.
International Search Report mailed Dec. 4, 2013 in Application No. PCT/US2013/044064.
U.S. Official Action Mailed Mar. 21, 2014, in U.S. Appl. No. 11/703,066.
U.S. Official Action Mailed Apr. 14, 2014, in U.S. Appl. No. 11/423,259.
U.S. Official Action Mailed Apr. 21, 2014, in U.S. Appl. No. 11/424,520.
U.S. Official Action Mailed Jun. 16, 2014, in U.S. Appl. No. 12/277,886.

* cited by examiner

MULTI-COMPONENT PACKAGING SYSTEM AND APPARATUS

CROSS-REFERENCE TO RELATED APPLICATIONS

The present application claims priority to related Provisional Patent Application Ser. No. 60/904,765 entitled MULTI-COMPONENT PACKAGING SYSTEM AND APPARATUS and filed on Mar. 2, 2007. The above disclosure is hereby incorporated in its entirety.

BACKGROUND

Since the development of the microwave oven, there has been a continuing consumer desire for microwave ready packaged meals. However, consumers desire packaged meals that are convenient to use, cooked evenly by the microwave, and taste like homemade food. Consumers additionally desire the packaged meals to be efficient and economic in use.

SUMMARY

An aspect of the present disclosure relates to a multi-component packaging system including a lower containing assembly, an upper containing assembly, and a cover.

Another aspect of the present disclosure relates to a multi-component packaging system including a lower containing assembly, an upper containing assembly, and a cover. The lower containing assembly defines an interior cavity that is adapted to receive a first food component. The upper containing assembly defines an interior that is adapted to receive a second food component. The upper containing assembly is adapted for engagement with the lower containing assembly. The cover is engaged with at least one of the lower containing assembly and the upper containing assembly. The cover includes a passage portion that defines a plurality of apertures.

Another aspect of the present disclosure relates to a multi-component packaging system having a base container, a tray, and a cover. The base container defines an interior cavity in which a first food component is disposed. The tray is disposed within the interior cavity of the base container and is selectively removable from the interior cavity. The tray defines an interior in which a second food component is disposed. The cover is releasably engaged with the base container. The cover includes a passage portion defining a plurality of apertures.

Another aspect of the present disclosure relates to a microwavable container system including a base container and a cover. The base container defines an interior cavity having an interior volume. The interior cavity is adapted to receive a first food component and a fluid. The cover is selectively engaged with the base container and includes a passage portion and a containment wall extending upwardly from a top surface of the cover. The containment wall defines a volume for retaining fluid that passes through the passage portion during cooking. The cover further includes a surface tension breakage feature for disrupting the surface tension of the fluid in the interior cavity of the base container during cooking.

Another aspect of the present disclosure relates to a cover for a microwavable container. The cover includes a top surface having a brim portion and a bottom surface oppositely disposed from the top surface. The bottom surface is adapted for engagement with a base container. A containment wall extends upwardly from the top surface, the containment wall defines a cavity having a plurality of fluid passages. The cavity defines a volume that is adapted to retain fluid that passes through the plurality of fluid passages during heating.

Another aspect of the present disclosure relates to a container assembly for a microwavable food product. The container assembly includes a base container and a cover. The base container defines an interior cavity with an inner volume. The cover is adapted for engagement with the base container and includes a top surface having a brim portion and an oppositely disposed bottom surface. The bottom surface is adapted for engagement with the base container. A plurality of fluid passages is disposed on the cover. A containment wall extends upwardly from the top surface and surrounds the plurality of fluid passages. The containment wall defines a cavity above the top surface having a volume that is adapted to retain fluid that passes through the plurality of fluid passages from the interior of the cavity of the base container during heating.

It will be understood that the term "fluid" as used in the present disclosure is not limited to liquids, but rather includes liquids, gases, and vapors.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

DRAWINGS

DETAILED DESCRIPTION

Reference will now be made in detail to the exemplary aspects of the present disclosure that are illustrated in the accompanying drawings. Wherever possible, the same reference numbers will be used throughout the drawings to refer to the same or like structure.

Given family commitments, work commitments, and household commitments, consumers rarely have time to prepare and clean-up after meals during the week. As a result, consumers may rely on microwave food products for their meals. While microwave food products are relatively easy to cook, what is desired is a microwave food product that is conveniently packaged for storage and cooking and that requires little clean-up after cooking.

Figure 1A:
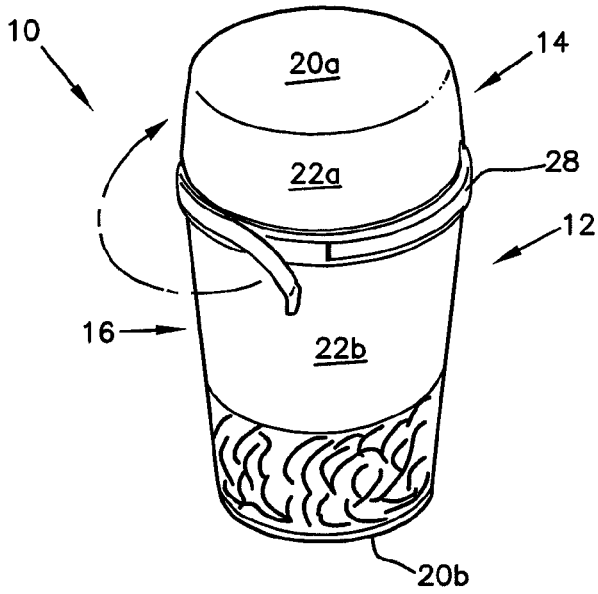
FIG. 1A is a perspective view of a multi-component packaging system having features that are examples of aspects in accordance with the principles of the present disclosure.
Figure 1B:
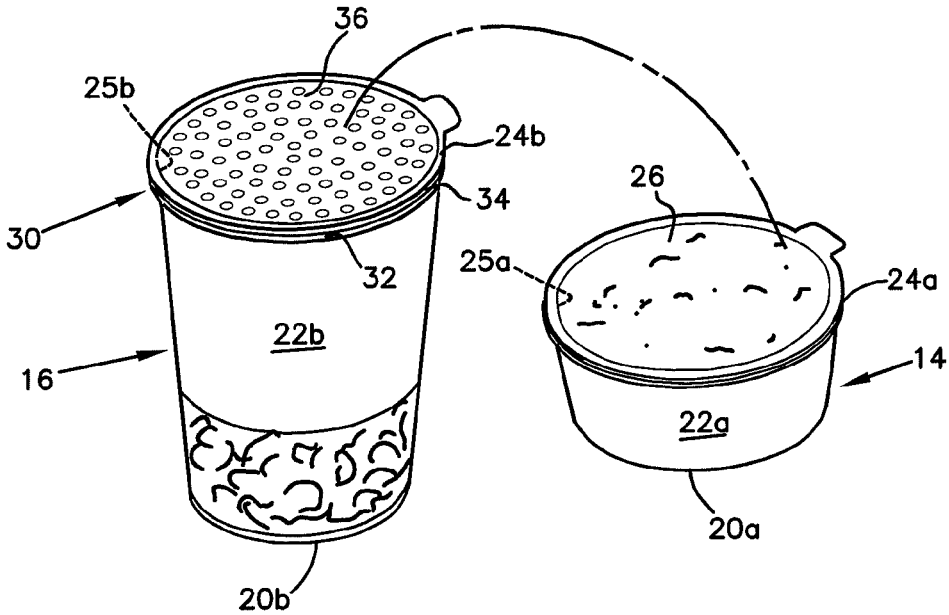
FIG. 1B is a perspective view of the multi-component packaging system of FIG. 1A with an upper containing assembly removed from the lower containing assembly.

Referring now to FIGS. 1A and 1B, a multi-component packaging system, generally designated 10, is shown. The multi-component packaging system 10 provides a system that is conveniently packaged for storage and cooking and requires little clean-up after cooking.

In one aspect of the present disclosure, the multi-component packaging system 10 includes at least one containing assembly, generally designated 12. The containing assembly 12 may be suitable for separably containing a plurality of food components, including meats, seafoods, sauces, toppings, starches (e.g., pasta, rice, etc.), vegetables, potatoes, fruits, dairy products, and the like.

In one aspect of the present disclosure, the multi-component packaging system includes an upper containing assembly 14 and a lower containing assembly 16. The upper containing assembly 14 and the lower containing assembly 16 are formed from an upper base assembly and a lower base assembly, respectively. The upper base assembly includes a base 20*a* and a sidewall 22*a*. The lower base assembly includes a base 20*b* and a sidewall 22*b*. Each sidewall 22*a*, 22*b* is continuous with the base 20*a*, 20*b*, respectively, and terminates in a free edge 24*a*, 24*b*, respectively. The free edges 24*a*, 24*b* define openings 25*a*, 25*b* in the upper and lower containing assemblies 14, 16.

A polymeric film 26 may be used to cover at least one of the upper containing assembly 14 and the lower containing assembly 16. The polymeric film 26 is sufficiently affixed to the free edge 24*a*, 24*b* of the at least one of the upper and lower containing assemblies 14, 16 to serve as a splatter guard when the at least one of the upper and lower containing assemblies 14, 16 is placed into a microwave oven for heating of food.

Any of the upper and lower containing assemblies 14, 16 may include a cover 30. In one aspect of the present disclosure, the cover 30 includes multiple layers. The cover 30 can include a first layer 32 and a second layer 34. The first layer 32 defines a plurality of apertures 36. The plurality of apertures 36 allows the flow of fluid into and out of the containing assembly 14, 16 on which the first layer 32 is affixed while preventing the contents of that containing assembly 14, 16 from spilling out. As previously stated, the term "fluid" as used in the present disclosure shall be understood to include liquids, gases, and/or vapors.

The second layer 34 may hermetically seal the contents of the containing assembly 14, 16. It will be understood, however, that the scope of the present disclosure is not limited to the second layer 34 hermetically sealing the contents of the containing assembly 14, 16. The second layer 34 may be removed, such as by peeling away, to reveal the first layer 32.

Figure 2A:
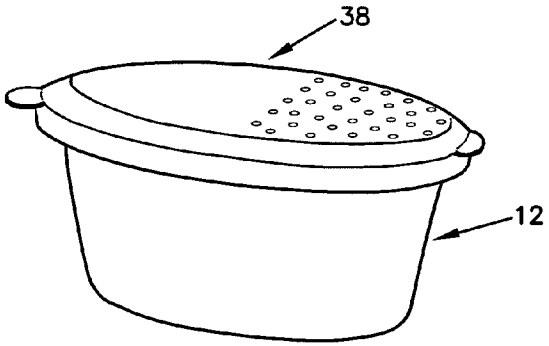
FIG. 2A is a perspective view of an alternate example of a multi-component packaging system having features that are examples of aspects in accordance with the principles of the present disclosure.
Figure 2B:
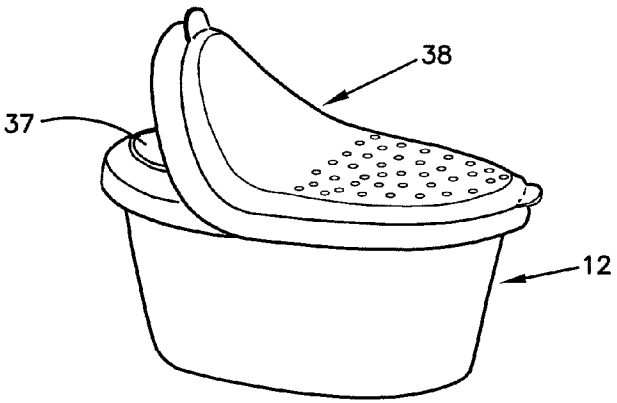
FIG. 2B is a perspective view of the multi-component packaging assembly of FIG. 2A with a multi-functional layer partially removed.
Figure 4:
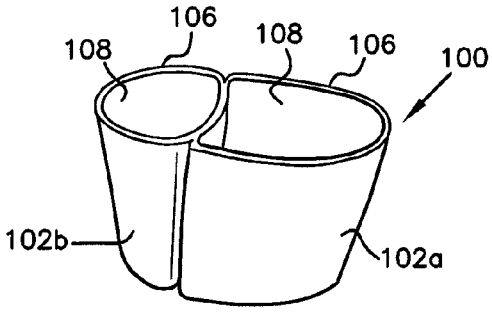
FIG. 4 is a perspective view of a multi-compartment containing assembly having features that are examples of aspects in accordance with the principles of the present disclosure.
Figure 5:
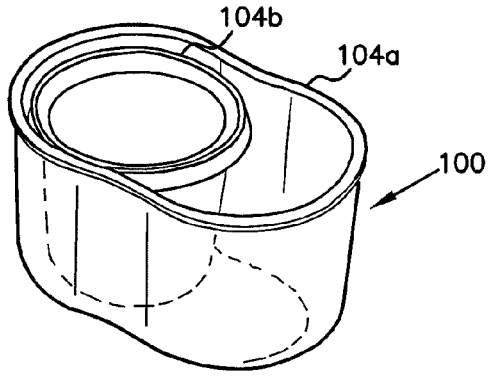
FIG. 5 is a perspective view of an alternate example of the multi-compartment containing assembly of FIG. 4.
Figure 6:
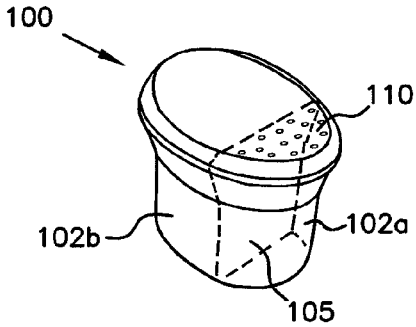
FIG. 6 is a perspective view of an alternate example of the multi-compartment containing assembly of FIG. 4 having a multi-functional layer.
Figure 7:
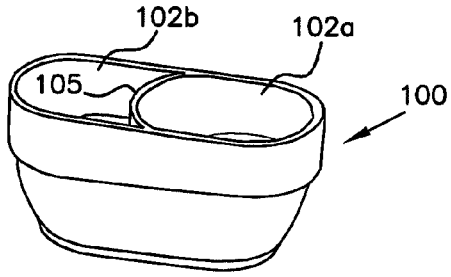
FIG. 7 is a perspective view of an alternate example of the multi-compartment containing assembly of FIG. 4.
Figure 8:
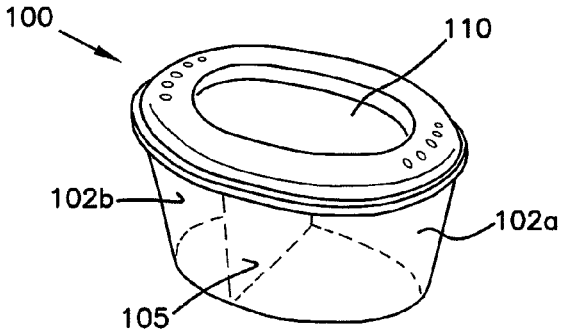
FIG. 8 is a perspective view of an alternate example of the multi-compartment containing assembly of FIG. 6.

Referring now to FIGS. 2A and 2B, an alternate example of the cover 30 is shown. The containing assembly 12 may include a sealing layer 37 (shown in FIG. 2B) suitable for sealing the contents of the containing assembly 12 and a durable cover 38 suitable for providing ventilated heating of the contents of the upper containing assembly 12 when the sealing layer 37 has been removed.

Figure 3A:
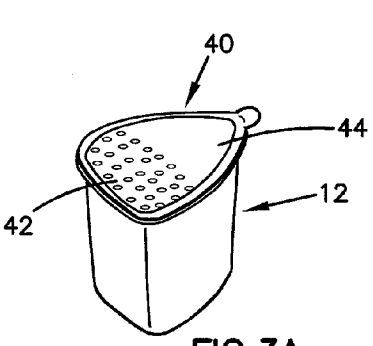
FIG. 3A is a perspective view of an alternate example of the multi-component packaging system of FIG. 2A.
Figure 3B:
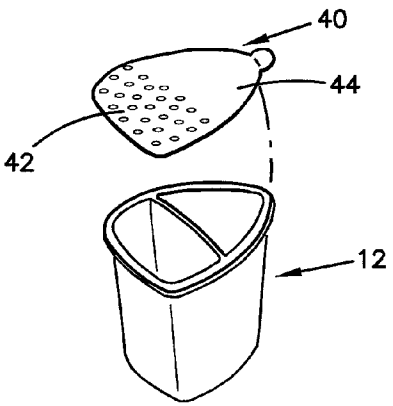
FIG. 3B is an exploded perspective view of the multi-component packaging system of FIG. 3A.

Referring now to FIGS. 3A and 3B, the containing assembly 12 of the multi-component packaging system 10 may also include a multi-functional single layer 40, wherein a section of the containing assembly 12 is covered with a multi-aperture sealing layer 42 and a section of the containing assembly 12 is covered by a sealing layer 44, and a rigid cover that covers the multi-functional single layer 40. The multi-functional layer 40 may be formed of a single sheet of material and may be openable at more than one location and reclosable.

Referring now to FIGS. 4-8, an alternate example of a multi-component packaging assembly 100 is shown. The multi-component packaging assembly 100 includes at least two containing sections 102. In the depicted examples, the multi-component packaging assembly 100 includes a first containing section 102*a* and a second containing section 102*b*. Each of the containing sections 102 is usable to house a product suitable for use with the product housed in the other section but which is stored separately. In one aspect of the present disclosure, the containing assembly 100 may comprise an outer container 104*a* enclosing an inner container 104*b* having a perimeter that is less than the perimeter of the outer container 104*a*. In another aspect of the present disclosure, the containers 104 may be formed from a tray or a base and may be separated from one another by a barrier 105 (shown in FIGS. 4 and 6-8). The multi-component packaging assembly 100 may include any or all of the components of the upper and lower containing assemblies 14, 16.

Each of the containing sections 102 has a top portion 106 (shown in FIG. 4) with a sealable aperture 108 (shown in FIG. 4) that is opened to access the product disposed within the containing section 102. At least one of the containing sections 102 may include a multi-aperture sealing assembly 110 (shown in FIGS. 6 and 8).

Figure 9:
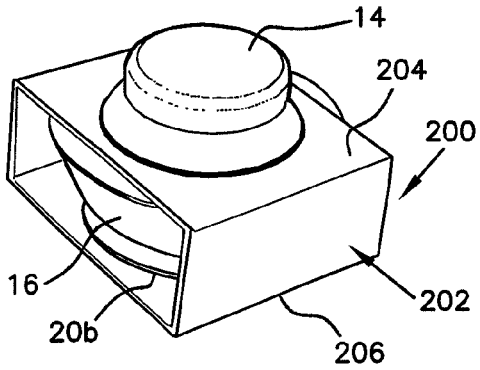
FIG. 9 is a perspective view of an alternate example of the multi-component packaging system of FIG. 1A having an exterior packaging.
Figure 10:
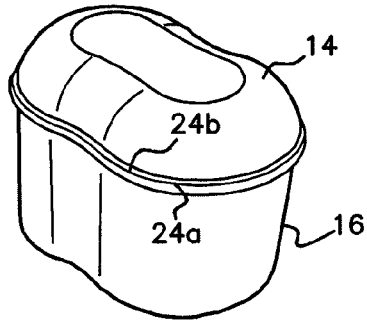
FIG. 10 is a perspective view of an assembled alternate example of multi-component packaging system of FIG. 1A.
Figure 11:
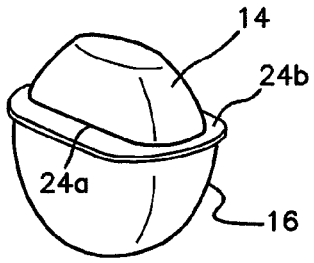
FIG. 11 is a perspective view of an assembled alternate example of multi-component packaging system of FIG. 1A.
Figure 12:
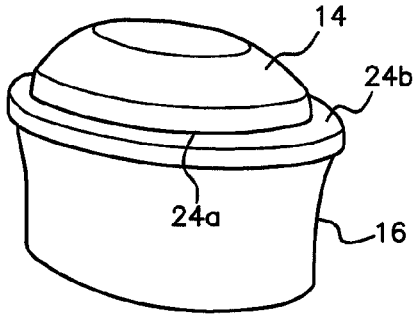
FIG. 12 is a perspective view of an assembled alternate example of multi-component packaging system of FIG. 1A.
Figure 13:
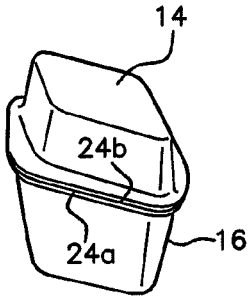
FIG. 13 is a perspective view of an assembled alternate example of multi-component packaging system of FIG. 1A.
Figure 14:
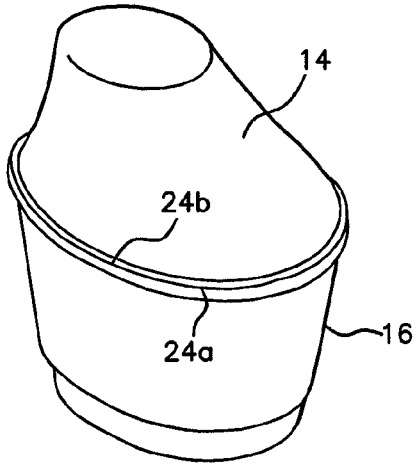
FIG. 14 is a perspective view of an assembled alternate example of multi-component packaging system of FIG. 1A.
Figure 15:
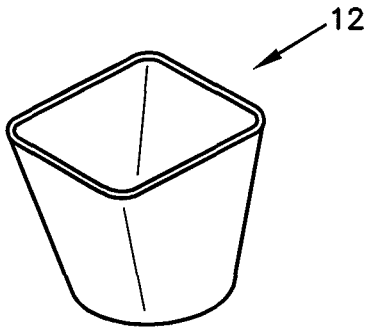
FIG. 15 is a perspective view of a container suitable for use with the multi-compartment containing assembly of FIG. 6.
Figure 16:
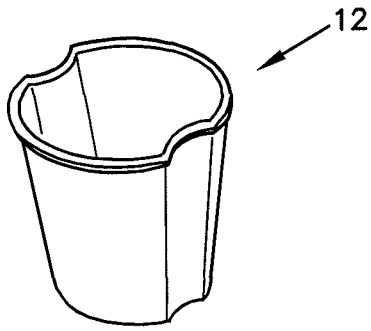
FIG. 16 is a perspective view of an alternate example of the container of FIG. 15.
Figure 17:
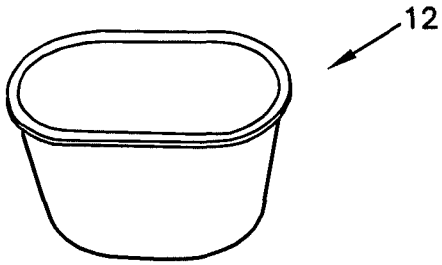
FIG. 17 is a perspective view of an alternate example of the container of FIG. 15.
Figure 18:
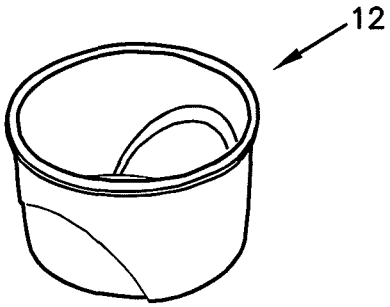
FIG. 18 is a perspective view of an alternate example of the container of FIG. 15.
Figure 19:
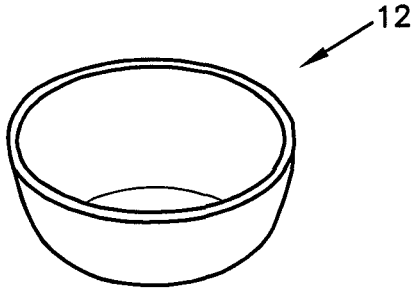
FIG. 19 is a perspective view of an alternate example of the container of FIG. 15.

Referring now to FIG. 9, an exterior packaging 200 is shown. In one aspect of the present disclosure, the exterior packaging 200 is a sleeve that surrounds at least one of the upper and lower containing assemblies 14, 16. The exterior packaging includes a plurality of panels 202 having display surfaces. In the depicted example of FIG. 9, a first panel 204 is disposed adjacent to the opening 25*b* (shown in FIG. 1B) of the lower containing assembly 16 while an oppositely disposed second panel 206 is disposed adjacent to the base 20*b* of the lower containing assembly 16.

Referring now to FIGS. 1A and 10-14, examples of the assembled multi-component packaging system 10 are shown. The free edge 24*b* of the lower container assembly 16 may be coupled with either the free edge 24*a* or the base 20*a* of the upper assembly 14. In one aspect of the present disclosure, the upper and lower containing assemblies 14, 16 are releasable secured together such that the free edges 24*a*, 24*b* overlay one another to protect the plurality of apertures 36. In the depicted example of FIG. 1A, the upper containing assembly 14 is inverted and coupled with the lower containing assembly 16 via a coupling means 28 (e.g., a shrink wrap band, an adhesive, etc.).

Referring now to FIGS. 15-19, alternate examples of the containing assembly 12 suitable for use with the multi-component packaging system 10 are shown. The containing assembly 12 may include various shapes and configurations including, but not limited to, those provided in FIGS. 15-19.

Figure 20:
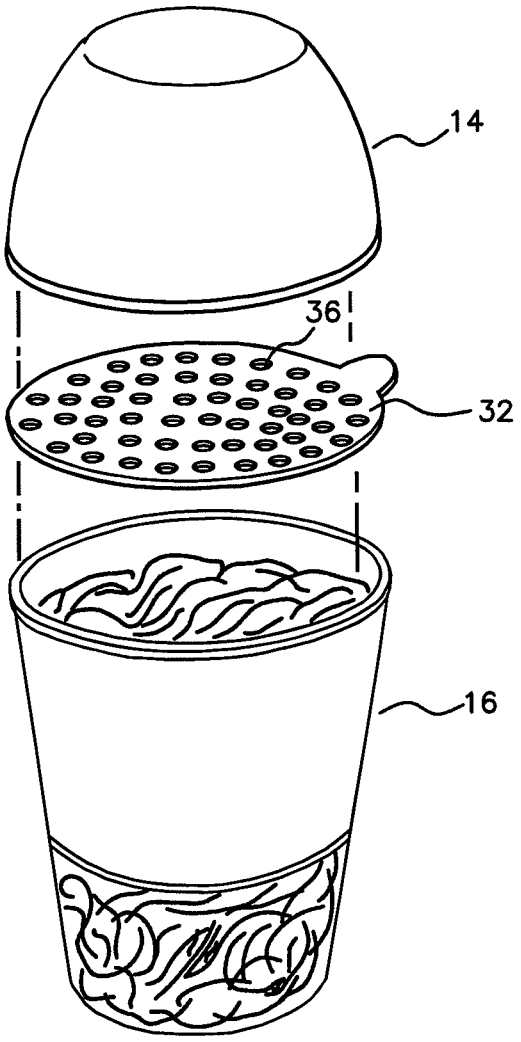
FIG. 20 is an exploded view of the multi-component packaging system of FIG. 1A.
Figure 21:
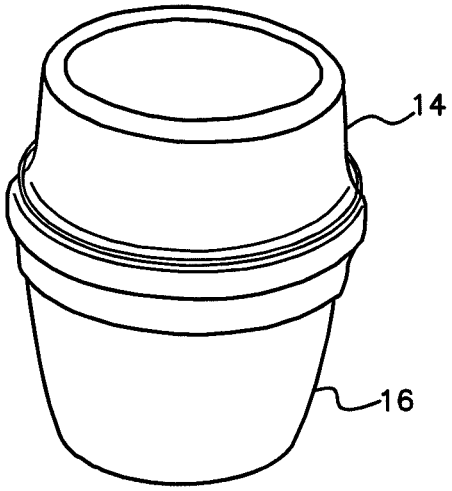
FIG. 21 is a perspective view of an alternate example of the multi-component packaging system of FIG. 1A.
Figure 22:
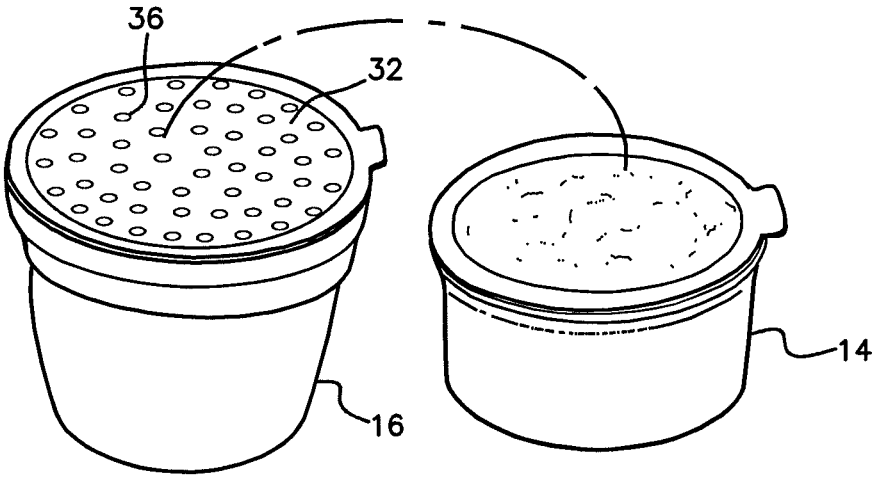
FIG. 22 is a perspective view of the multi-component packaging system of FIG. 21 with the upper and lower containing assemblies disengaged.

Referring now to FIGS. 20-26, a method of using the multi-component packaging system 10 will be described. As depicted in FIGS. 20-22, the upper and lower assemblies 14, 16 are separated from each other. In one aspect of the present disclosure, the exterior packaging 902 (shown in FIG. 9) or the coupling means 28 (shown in FIG. 1A) is removed in order to separate the upper and lower assemblies 14, 16. In the depicted example, the lower assembly 16 includes the first layer 32 having the plurality of apertures 36.

Figure 23:
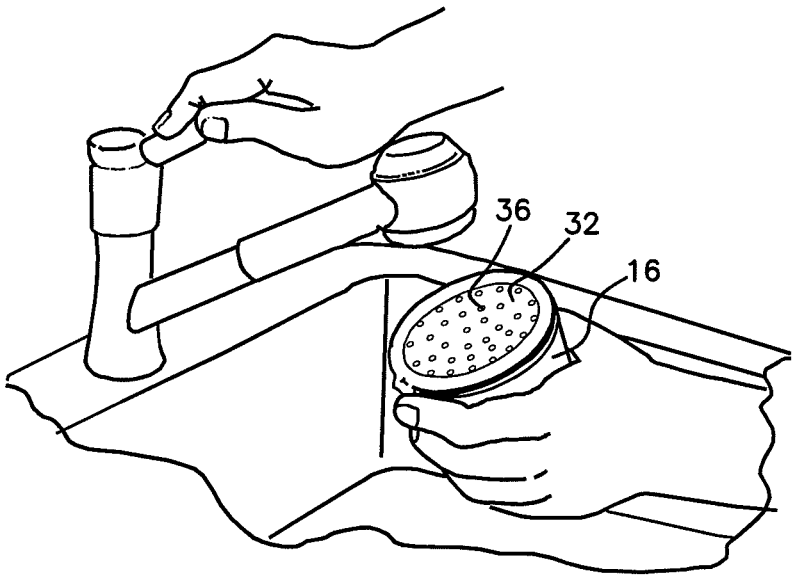
FIG. 23 is a perspective view of a fluid being added to the lower containing assembly of FIG. 22.

In FIG. 23, with the upper and lower assemblies 14, 16 separated, a fluid (e.g., water, broth, etc.) is added to the lower assembly 16 such that the fluid fills at least a portion of the lower assembly 16. In the depicted example of FIG. 23, the fluid is passed through the plurality of apertures 36 of the first layer 32. In another aspect of the present disclosure, the first layer 32 is removed from the lower assembly 16 so that the fluid can be added to the lower assembly 16 and then the first layer 32 is reapplied to the lower assembly 16.

Figure 24:
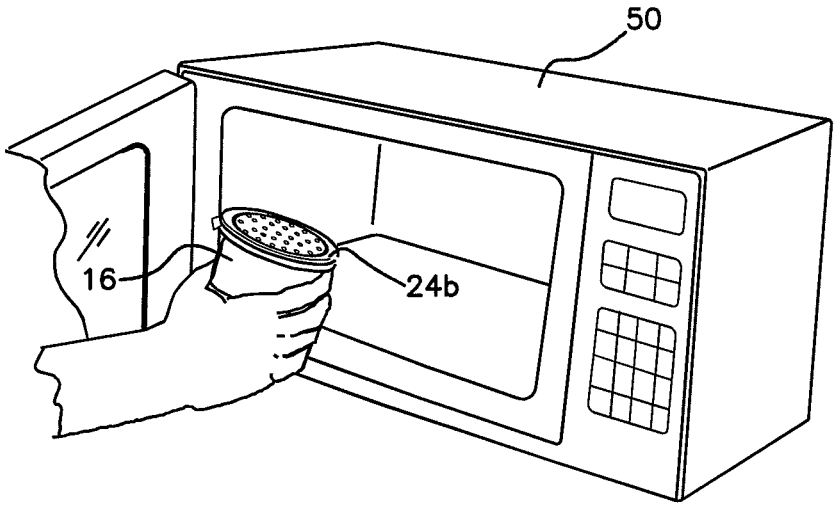
FIG. 24 is a perspective view of the lower containing assembly of FIG. 23 being inserted into a microwave oven for heating.
Figure 25:
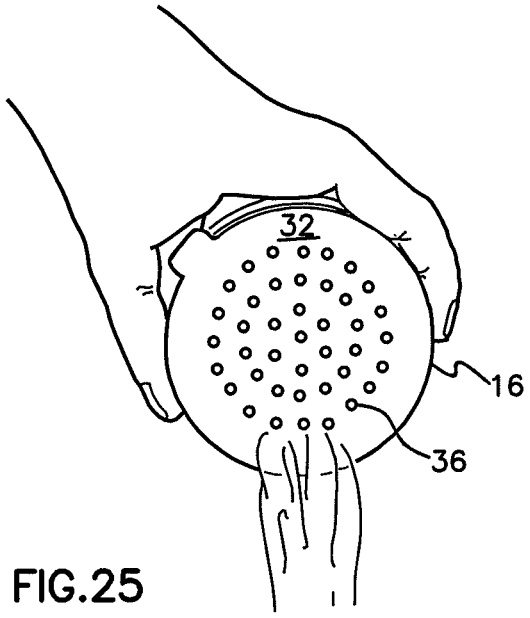
FIG. 25 is a perspective view of the fluid from the lower containing assembly of FIG. 24 being drained.

Referring now to FIGS. 24 and 25, the lower container 16 can be placed in a microwave oven 50 (shown in FIG. 24) for heating the contents of the lower container 16. After the contents of the lower container 16 are heated, the fluid within the lower containing assembly 16 can be drained (see FIG. 25) through the plurality of apertures 36 in the first layer 32. As the first layer 32 is engaged with the free edge 24*b* of the lower containing assembly 16, the food component within the lower containing assembly 16 is retained within the lower containing assembly 16 during draining of the fluid.

Figure 26:
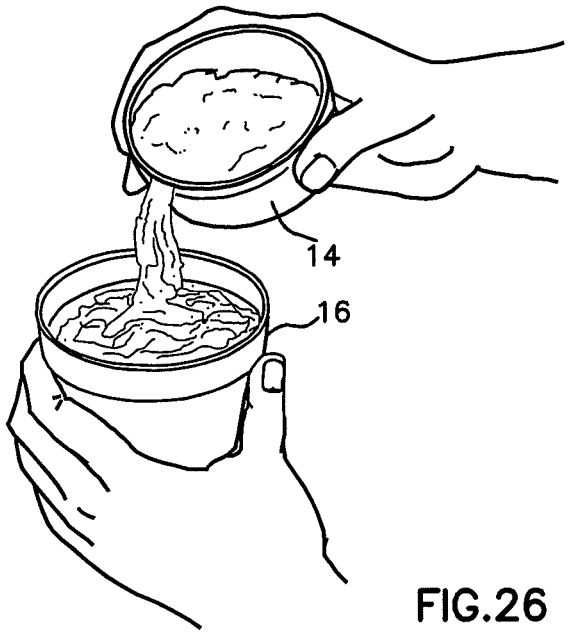
FIG. 26 is a perspective view of the contents of the upper containing assembly being added to the lower containing assembly.

Referring now to FIG. 26, the food component within the upper containing assembly 14 can be added to the food component of the lower containing assembly 16. In one aspect of the present disclosure, the food component of the upper containing assembly 14 can be heated prior to mixing with the food component of the lower containing assembly 16. Alternatively, the heated food component of the lower containing assembly can heat the food component of the upper containing assembly upon its addition to the food component of the lower containing assembly.

The multi-component packaging system 10 may be composed of a highly durable and reusable material such as a plastic, rigid plastic, polymer, metal or metal alloy, styrofoam or like material, or may be composed of a disposable and easily biodegradable material, such as paper, or may be composed of any other material suitable for separably containing a variety of food components as described.

The components of the multi-component packaging system 10 may comprise a thermal insulating layer. For instance, the components may be composed of a thermoformable polystyrene or polyethylene material or optionally a thermoformable plastics material mix. The thermal insulating layer may comprise an organic thermoplastic fiber based material comprising polyester, polyethylene or polypropylene. In one example, the thermal insulating layer is a fiberfill batting comprising polyester. Alternatively, the thermal insulating layer may comprise melt blown fibers, such as melt blown polyolefins, sold as THINSULATE®, by 3M.

Many other variations of insulating material for the thermal insulating layer can be used with the multi-component packaging system 10. For instance, the thermal insulating layer may comprise a foam, such as foamed polypropylene, or any other foam composition as known in the art that may be subjected to microwave heating. Or the thermal insulating layer may be made of an inorganic thermoplastic fiber based material comprising glass wool, borosilicate glass or rockwool. The packaging system components may be formed using standard molding techniques, including but not limited to injection molding, thermoforming, and blow molding.

Any of the components of the multi-component packaging system 10 may also comprise a first, or inner-most fabric layer, a second inner-most insulating layer which includes a polymeric foam, a third inner-most metallized polymer film reflective layer, and an outer-most fabric mesh layer. Also known in the film art is a thin electrical tape which comprises a polyester web-reinforced polyester film, as disclosed in 3M Utilities and Telecommunications OEM.

The thermal insulating layer may be laminated to multilayer face materials. By "lamination" is meant uniting layers of material by an adhesive, by heating or other means. The face material may be film, paper and/or fabric. The film is made of a thermoplastic material comprising polyester, polyethylene or polypropylene. In one example, the thermal insulating layer is laminated between two sheets of face material of film, paper or fabric. However, it is within the scope of the present disclosure to laminate a single sheet of face material to the thermal insulating layer. The use of a single sheet of face material will not affect the thickness of the packaging material substantially, since the thickness of the face material is insignificant compared to the total thickness of the packaging material. The packaging material of the present disclosure may be thick enough, such as greater than 0.0075 inch (0.0190 cm.) thick, to provide adequate insulation for a package. Also, the packaging material may be thin enough to be flexible, and should be preferably less than 0.07 inch (0.1778 cm). It is contemplated however, that further additional examples of the containing assembly 12 may be substantially rigid and inflexible for application requiring a more durable containing assembly 12.

In an example suitable for microwave preparation, at least one of the components of the multi-component packaging system 10 may also comprise a microwave susceptible coating. Composite materials for use as microwave susceptors are also known. U.S. Pat. No. 5,021,293 shows a polyethylene terephthalate film coated with flakes of electrically conductive metal or metal alloy. U.S. Pat. No. 4,892,782 shows drapable liquid permeable woven or nonwoven fibrous dielectric substrates that are coated with susceptor materials which can be wrapped around food items for microwave heating. In one example, the microwave susceptible coating preferably is a metal or metal alloy, such as aluminum, stainless steel, nickel/iron/molybdenum alloys and nickel/iron/copper alloys. The coating is applied to an outer surface of first layer, preferably by vapor coating or alternatively by coating a solution of metal particles dispersed in a solvent over a surface of the layer. The coating could also be applied to second layer before joining layers together if layers are separate layers. For a metal or metal alloy as the susceptor, the preferred coating thickness may be from about 20 to 100 Angstroms, preferably from about 50 to 70 Angstroms. Alternatively, the coating thickness for a metallic microwave susceptible coating may be measured in optical density as measured with a Tobias TBX Densitometer, offered by Tobias Associates, Inc. of Glenside, Pa., USA, and preferably is in the range of from about 0.35 to 0.12. Further, a sealant may coat the microwave susceptible coating. The sealant comprises a layer of one or more polymers, such as a polyester copolymer, poly(vinylidene chloride), or a copolymer of ethylene with vinyl acetate.

Any or all components of the multi-component packaging system 10 and contents may require sterilization such as retorting to ensure bacterial elimination from the food products enclosed therein. Retorting may refer to any process of cooking food in the package it is sold in, such as meat or vegetables that need to cook at a particular temperature to kill off the micro-organisms and avoid botulism. The temperature is generally around 121 degrees Celsius. Retorting of the various sections may occur separately, to preserve the desired texture, flavor, appearance and other characteristics of the separate food components. The various components of the multi-component packaging system 10 and apparatus may then be assembled in the manners described, or in any manner suitable for assembling and packaging the food contents for sale and consumption.

The packaging material of the present disclosure can further include a coating on the face material. The coating is provided on the non-heat sealable surface of the face material. This coating is printable, so that the packaging material may also function as a label. The coating is a standard print primer based on aqueous polymer dispersions, emulsions or solutions of acrylic, urethane, polyester or other resins well known in the art. Alternatively, if the thermal insulating layer is previously printed, and the face material is clear, the need for coating the face material to make it printable may be eliminated.

The multi-component packaging system 10 may further comprise a receptacle for storing a utensil such as a fork, spoon, knife or any other utensil suitable for mixing or consuming meal components.

The methods disclosed may be implemented as sets of instructions, through a single production device, and/or through multiple production devices. Further, it is understood that the specific order or hierarchy of steps in the methods disclosed are examples of exemplary approaches. Based upon design preferences, it is understood that the specific order or hierarchy of steps in the method can be rearranged while remaining within the scope and spirit of the present disclosure.

Figure 27:
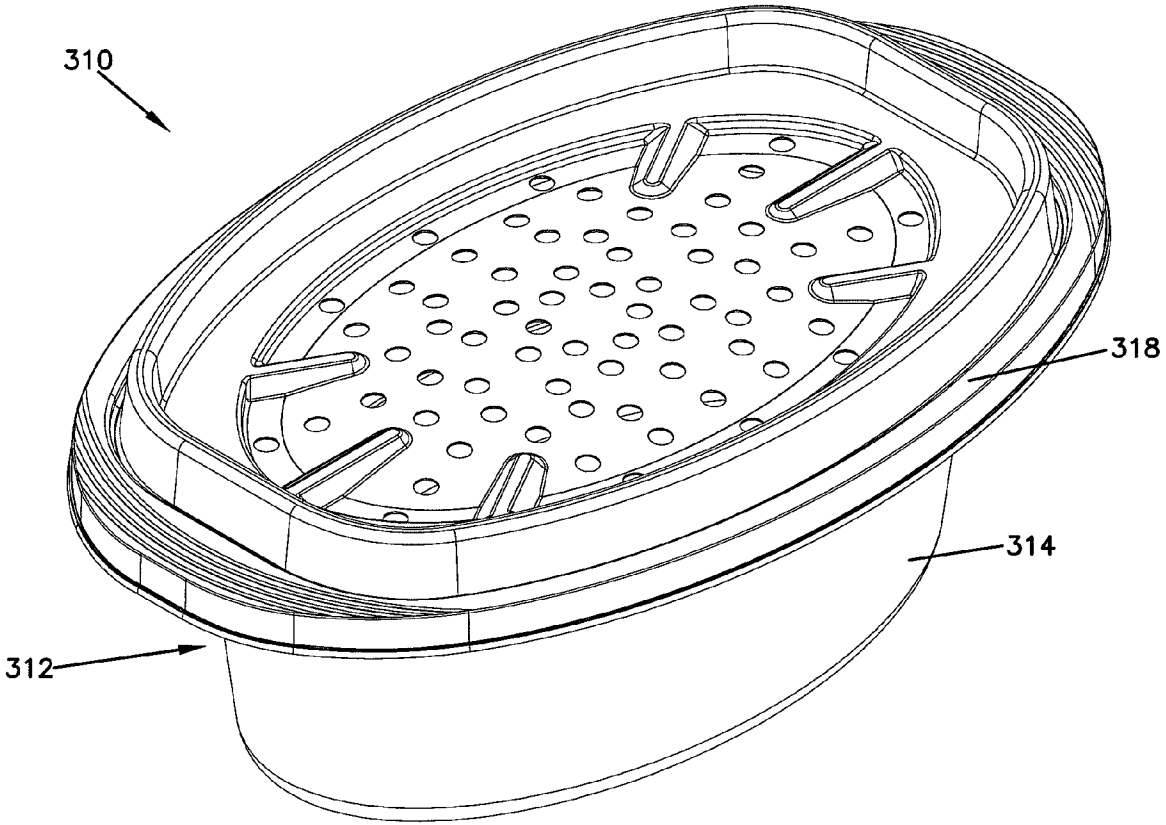
FIG. 27 is a perspective view of an alternate example of a multi-component packaging system having features that are examples of aspects in accordance with the present disclosure.
Figure 28:
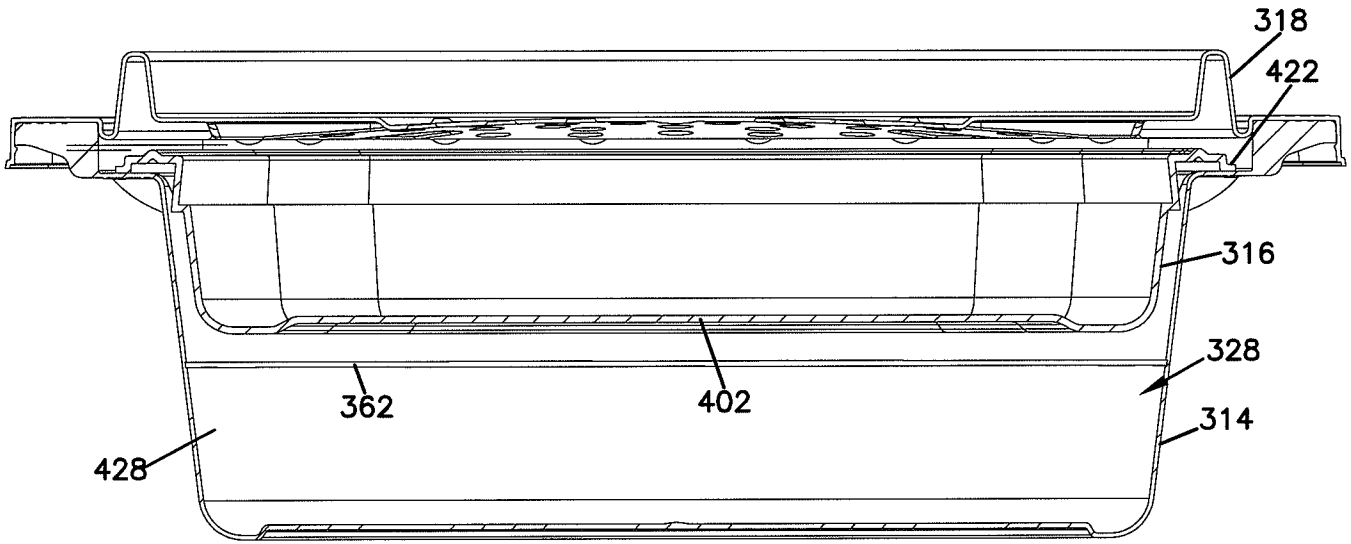
FIG. 28 is a cross-section view of the multi-component packaging system of FIG. 27.

Referring now to FIGS. 27 and 28, an alternate example of a multi-component package system, generally designated 310 is shown. The multi-component package system 310 includes a container assembly 312. In one aspect of the present disclosure, the container assembly 312 includes a base container 314, a tray 316 (shown in FIG. 28) disposed in the base container 314, and a cover 318 engaged with the base container 314.

Figure 29:
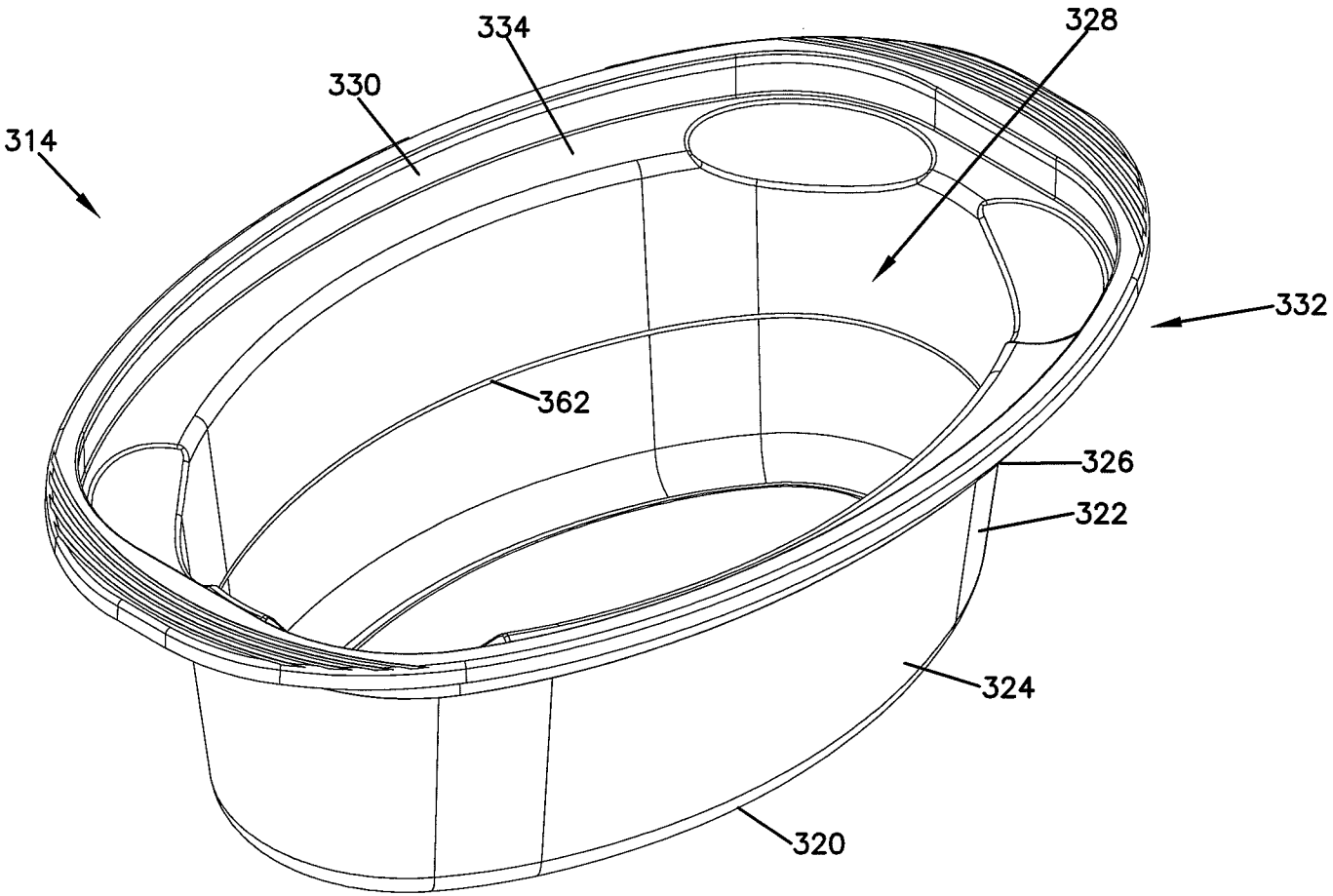
FIG. 29 is a perspective view of a base container suitable for use with the multi-component packaging system of FIG. 28.
Figure 30:
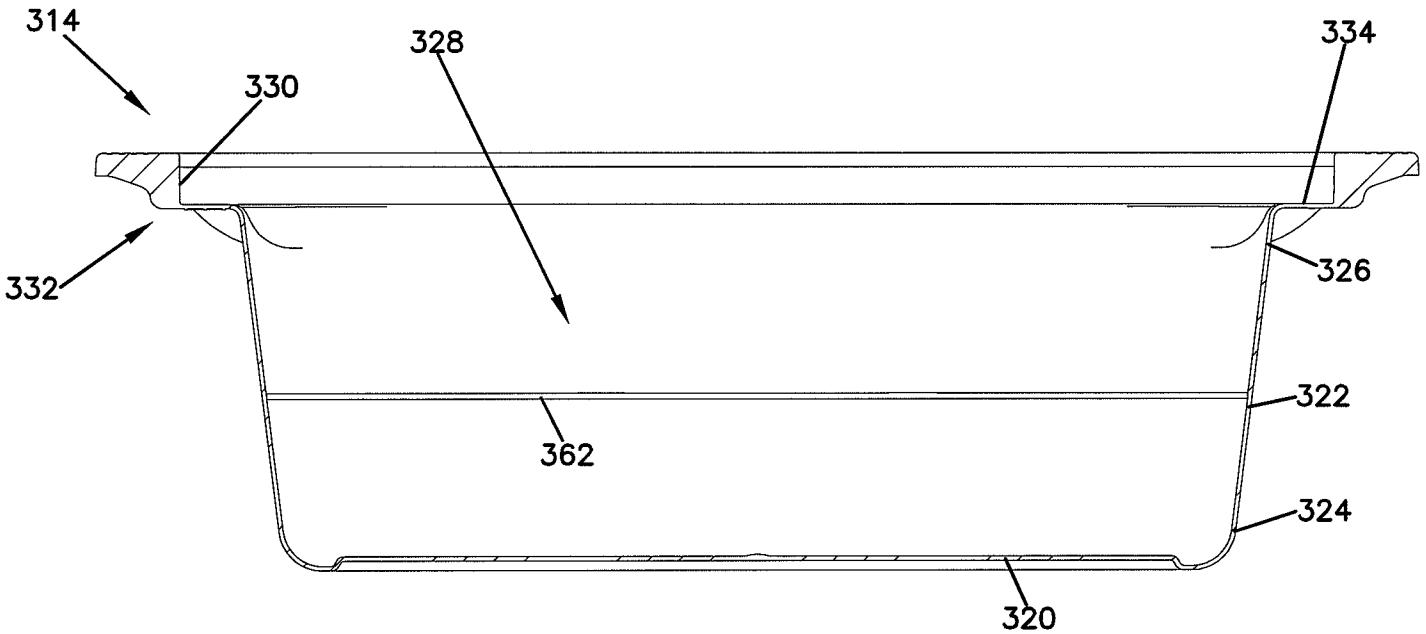
FIG. 30 is a cross-sectional view of the base container of FIG. 29.
Figure 31:
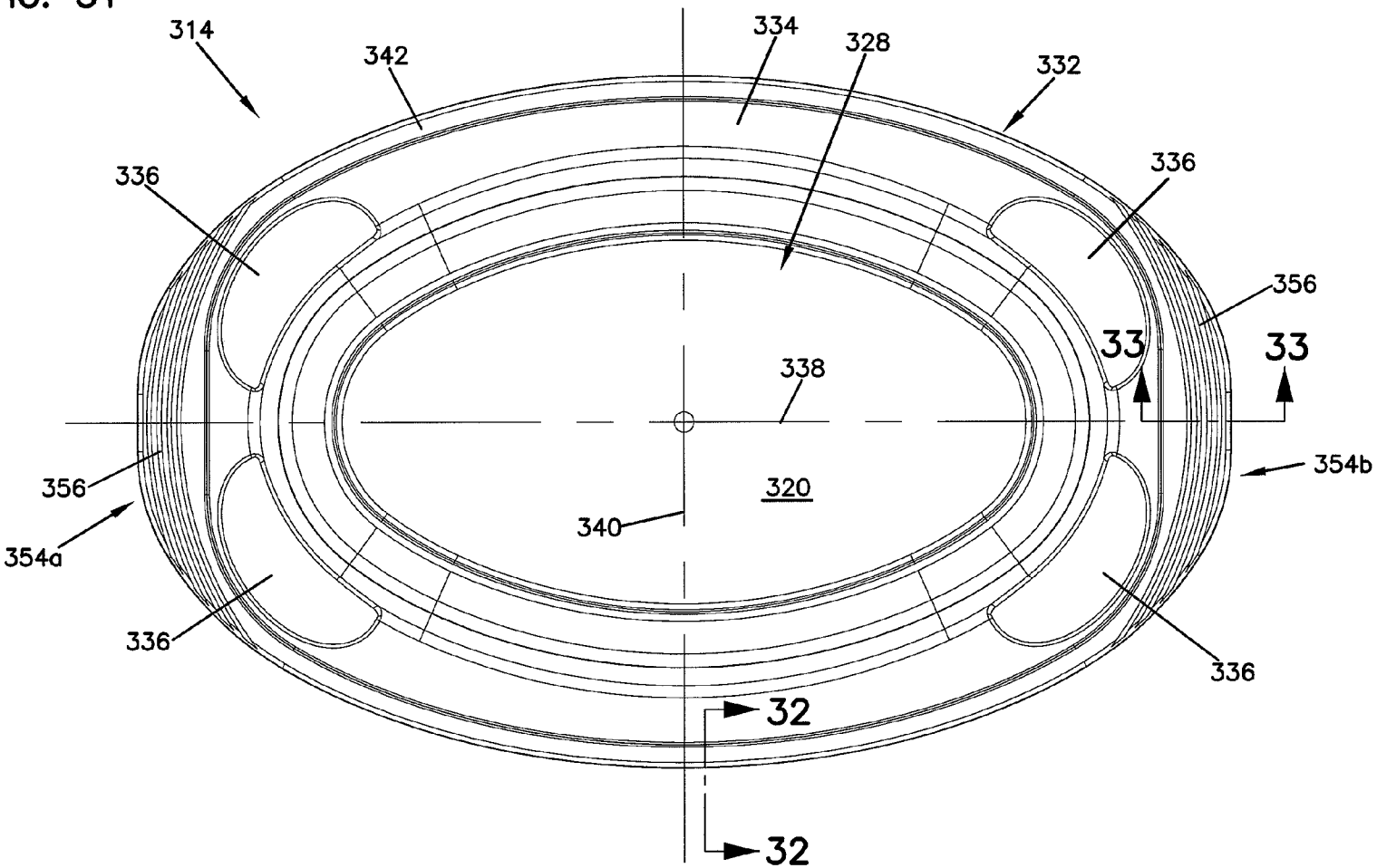
FIG. 31 is a top view of the base container of FIG. 29.

Referring now to FIGS. 29-31, the base container 314 is shown. The base container 314 includes a base wall 320 and a sidewall 322. The sidewall 322 includes a first end 324 and an oppositely disposed second end 326. The first end 324 is connectedly engaged with the base wall 320 such that the sidewall 322 extends outwardly from the base wall 320. In one aspect of the present disclosure, the base wall 320 and the sidewall 322 are continuous or monolithic.

The base wall 320 and the sidewall 322 cooperatively define an interior cavity 328. The interior cavity 328 of the base container 314 defines an interior volume. In one aspect of the present disclosure, the interior volume is in the range of about 8 oz. to about 32 oz. In another aspect of the present disclosure, the interior cavity 328 defines an interior volume less than or equal to about 32 oz., less than or equal to about 24 oz., less than or equal to about 20 oz., less than or equal to about 18 oz., less than or equal to about 16 oz., less than or equal to about 12 oz., or less than or equal to about 8 oz.

The sidewall 322 defines an opening 330 to the interior cavity 328 disposed at the second end 326 of the sidewall 322. In one aspect of the present disclosure, the opening 330 defines an area in the range of about 20 $cm^2$ to about 774 $cm^2$. In another aspect of the present disclosure, the opening 330 defines an area less than or equal to about 645 $cm^2$, less than or equal to about 322 $cm^2$, less than or equal to about 258 $cm^2$, less than or equal to about 192 $cm^2$, less than or equal to about 128 $cm^2$, less than or equal to about 64 $cm^2$, or less than or equal to about 32 $cm^2$.

A flange portion 332 is disposed at the second end 326 of the sidewall 322. The flange portion 332 of the sidewall 322 includes a lip 334. In one aspect of the present disclosure, the lip 334 extends around a portion of the interior cavity 328. In the depicted example of FIGS. 29-31, the lip 334 extends completely around the interior cavity 328 and includes portions that are generally planar in shape.

The lip 334 defines a plurality of recesses 336. In one aspect of the present disclosure, the lip 334 defines at least two recesses 336. In the depicted example of FIGS. 29-31, the lip 334 defines four recesses 336. Each recess 336 of the plurality of recesses 336 is a depression in the lip 334. The recesses 336 are axis-symmetric about the lip 334. In the depicted example, the recesses 336 are symmetric about a first center line 338 (shown in FIG. 31) and a second center line 340 (shown in FIG. 31) that is generally perpendicular to the first center line 338. In one aspect of the present disclosure, the recesses 336 include bottom surfaces that are generally slanted or angled toward the interior cavity 328 of the base container 314. This slanting or angling of the bottom surfaces of the recesses 336 allows food stuff such as cooking fluid or food product that is contained in the base container 314 during cooking to be directed toward the interior cavity 328 in the event the fluid or food product gets disposed in the recesses 336 before, during, or after cooking.

Figure 32:
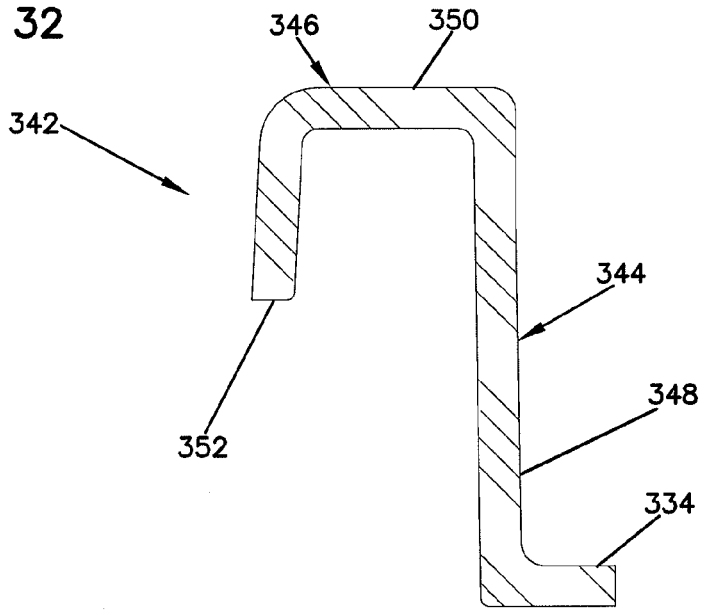
FIG. 32 is a cross-sectional view of a flange portion of the base container of FIG. 29 taken on line 32-32 of FIG. 31.
Figure 33:
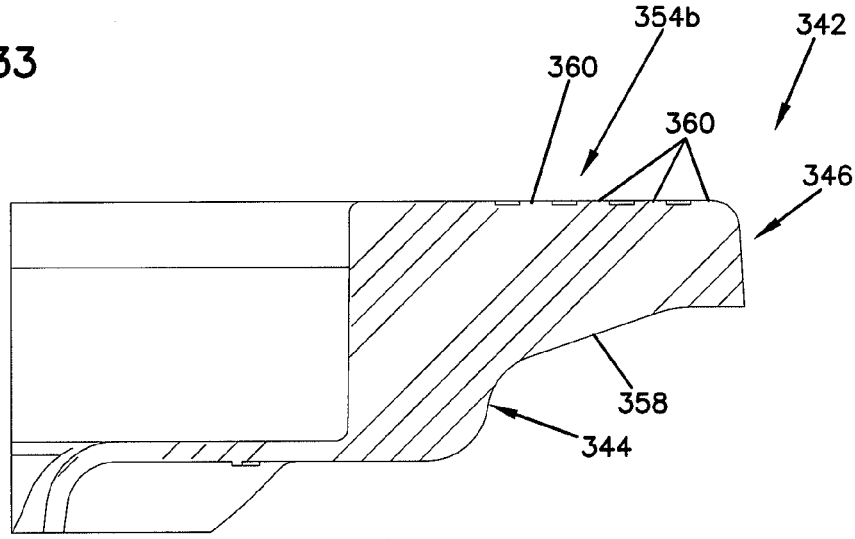
FIG. 33 is a cross-sectional view of a second handle of the base container of FIG. 29 taken on line 33-33 of FIG. 31.

Referring now to FIGS. 31-33, the flange portion 332 of the sidewall 322 further defines a rim portion 342. The rim portion 342 includes a base end 344 and a free end 346. The base end 344 is connectedly engaged with the lip 334. The base end 344 defines an inner surface 348 that faces the interior cavity 328 of the base container 314. In the depicted example, the base end 344 extends outwardly from the lip 334 in a generally perpendicular direction.

The free end 346 of the rim portion 342 extends outwardly from the base end 344 and defines an upper surface 350. In the depicted example, the free end 346 extends outwardly from the base end 344 in a generally perpendicular direction. The free end 346 includes an edge 352 that will be described in greater detail subsequently.

Figure 34:
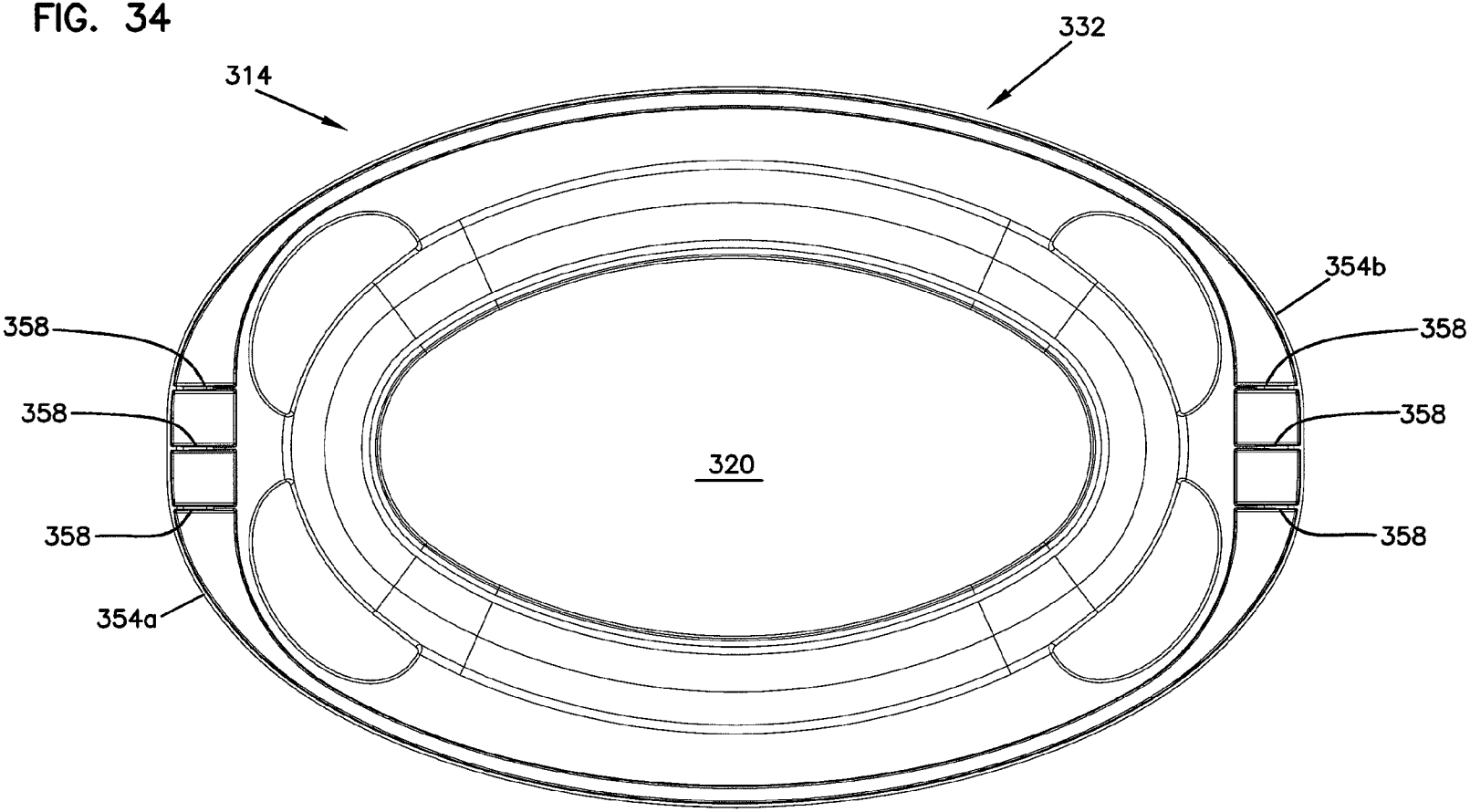
FIG. 34 is a bottom view of the base container of FIG. 29.

Referring now to FIGS. 31, 33 and 34, the flange portion 332 further defines a first and second handle 354*a*, 354*b* laterally disposed about the rim portion 342. In one aspect of the present disclosure, the first and second handles 354*a*, 354*b* extend outwardly from the base end 344 of the rim portion 342. This positioning of the first and second handles 354*a*, 354*b* provide the consumer with a gripping location that is disposed away from the base container 314, which reduces the risk of the consumer being harmed by the heat of the food component in the interior cavity 328 after cooking.

In another aspect of the present disclosure, each of the first and second handles 354*a*, 354*b* include a gripping surface 356 and a plurality of reinforcement members 358 (shown in FIG. 34). The gripping surface 356 is a textured surface that is adapted to reduce the risk of slipping after being grasped by a consumer. In the depicted example of FIG. 31, the gripping surface 356 includes a plurality of protrusions 360. Each of the plurality of protrusions 360 are equally spaced from adjacent protrusions 360.

As best shown in FIG. 33, the reinforcement members 358 extend outwardly from the base end 344 of the rim portion 342 toward the free end 346. The reinforcement members 358 of the handles 354 provide stability to the base container 314 by minimizing the amount of deflection of the handles 358 when the base container 314 is picked up or moved by the handles 354. In addition, the reinforcement members 354 provide a surface against which a consumer can place a finger to pick-up or move the base container 314.

Referring now to FIGS. 35-38, the tray 316 is shown. In one aspect of the present disclosure, the tray 316 is sized to be received within the interior cavity 328 of the base container 314 through the opening 330 of the sidewall 322.

The tray 316 includes a base 402 and a side 404. The side 404 includes first end portion 406 and an oppositely disposed second end portion 408. The first end portion 406 is connectedly engaged with the base 402 such that the side 404 extends outwardly from an outer periphery of the base 402. In one example, the base 402 and the side 404 are continuous or monolithic.

The base 402 and the side 404 cooperatively define an interior 410. The side 404 defines a tray opening 412 to the interior 410 disposed at the second end portion 408 of the side 404.

Figure 37:
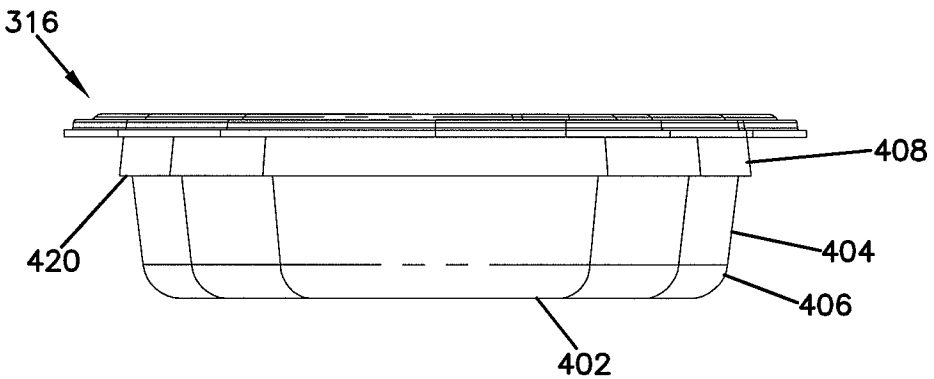
FIG. 37 is a right side view of the tray of FIG. 35.
Figure 38:
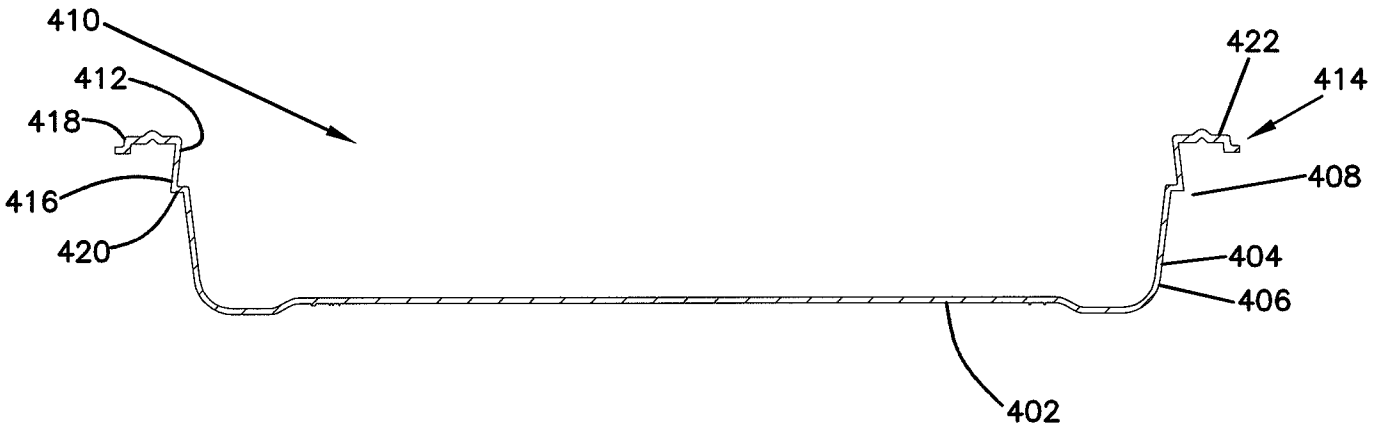
FIG. 38 is a cross-sectional view of the tray of FIG. 35 taken on line 38-38 of FIG. 36.

Referring now to FIGS. 37-38, the side 404 includes a flange 414 disposed at the second end portion 408 of the side 404. The flange 414 includes a first axial end portion 416 and an oppositely disposed second axial end portion 418. In the depicted example, the flange 414 is continuous or monolithic with the side 404.

The flange 414 includes a ridge 420 disposed at the first axial end portion 416. The ridge 420 extends outwardly from the side 404. In one aspect of the present disclosure, the ridge 420 extends around a portion of the interior 410. In the depicted example of FIGS. 35-39, the ridge 420 extends completely around the interior 410.

The flange 414 further includes a rim 422 disposed at the second axial end portion 418. The rim 422 extends outwardly from the side 404 and is adapted for engagement with the lip 334 of the base container 314.

Figure 35:
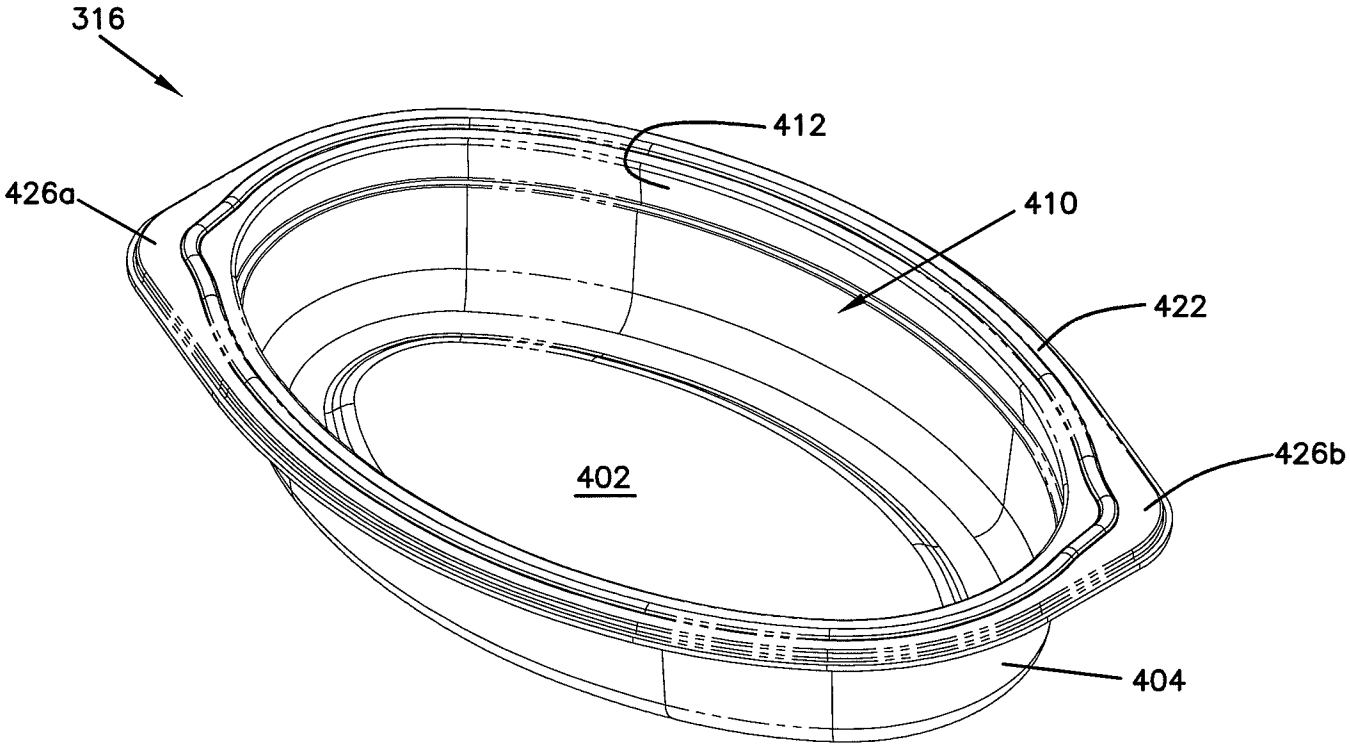
FIG. 35 is a perspective view of a tray suitable for use with the multi-component packaging system of FIG. 27.
Figure 36:
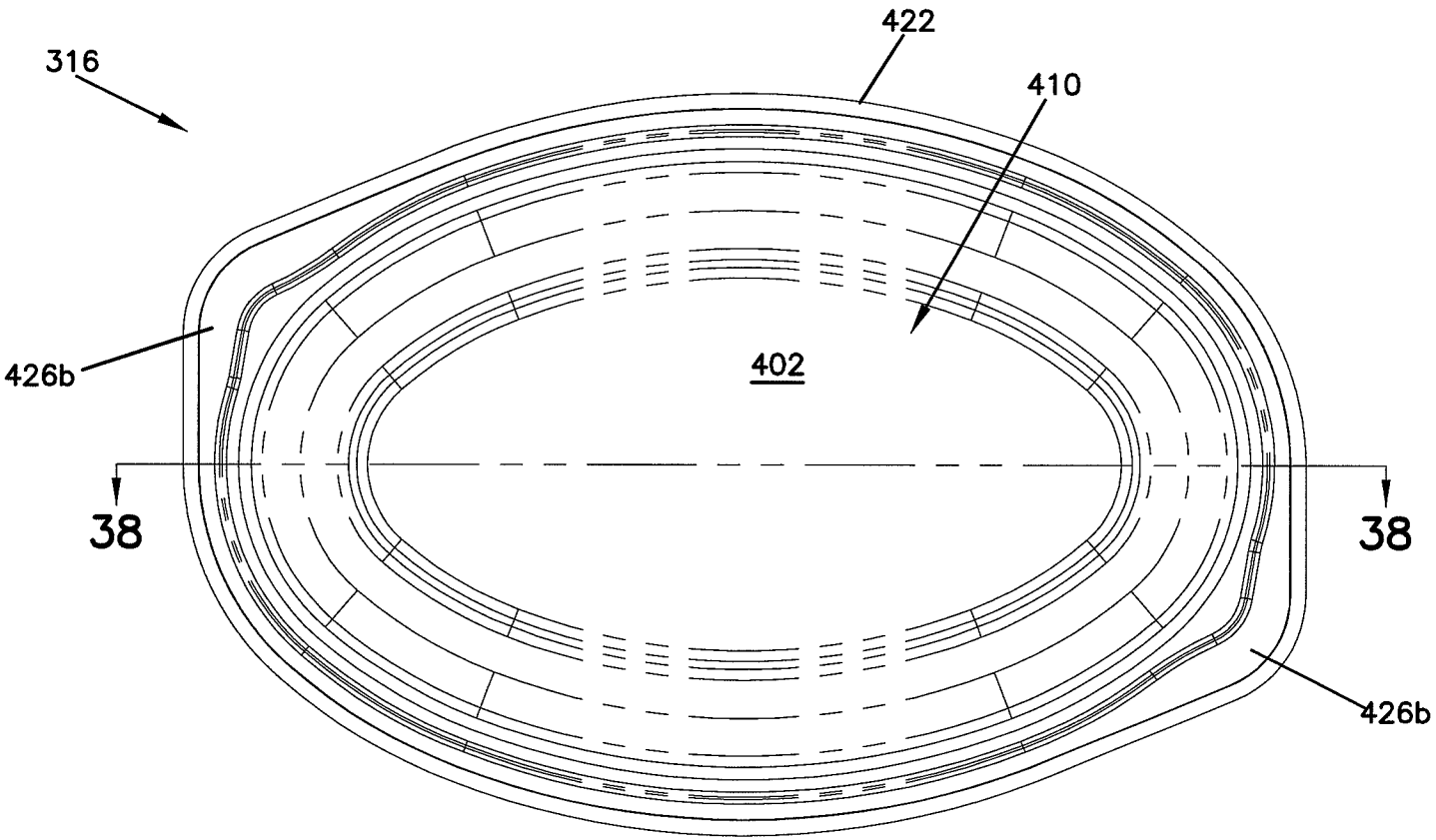
FIG. 36 is a top view of the tray of FIG. 35.

Referring now to FIGS. 35 and 37, the rim 422 includes a first and second handle portion 426*a*, 426*b* in one aspect of the present disclosure. The first handle portion 426*a* is oppositely disposed about the rim 422 from the second handle portion 426*b*. The first and second handle portions 426*a*, 426*b* are sized such that a consumer can use a thumb and forefinger to grasp the first and second handle portions 426*a*, 426*b* to pick-up and/or move the tray 316. The first and second handle portions 426*a*, 426*b* are disposed outwardly from the side 404 such that the consumer can grasp the tray 316 at a location disposed away from the contents of the interior 410, which may be in a heated condition, thereby reducing the risk of injury to the consumer.

Figure 39:
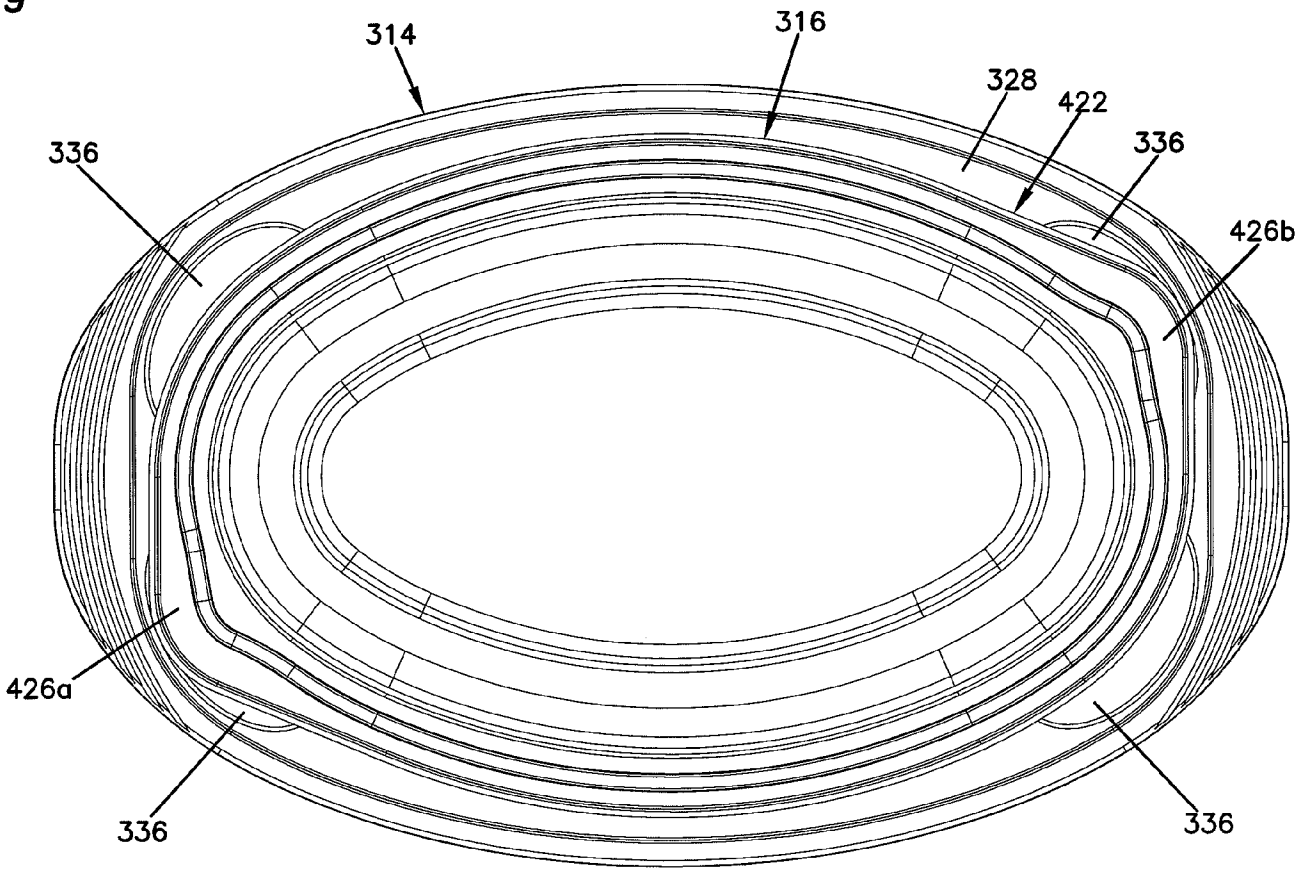
FIG. 39 is a top view of the tray of FIG. 35 inserted into an interior cavity of the base container of FIG. 29.

Referring now to FIGS. 28 and 39, the tray 316 is shown disposed in the interior cavity 328 of the base container 314. In one aspect of the present disclosure, the first and second handle portions 426*a*, 426*b* are disposed adjacent to the recesses 336 in the lip 334. The recesses 336 facilitate the selective removal of the tray 316 from the interior cavity 328 of the base container 314. The recesses 336 in the lip 334 of the base container 314 allow the consumer to insert a digit into the recess 336 and position that digit under the rim 422 of the tray 316. With digits positioned under the rim 422 of the tray 316, the tray 316 can be lifted from the base container 314 without spilling the contents of the tray 316.

As previously stated, the rim 422 is adapted for engagement with the lip 334 of the base container 314. As the tray 316 is lowered into the interior cavity 328 of the base container 314, a portion of the rim 422 abuts a portion of the lip 334. The engagement of the rim 422 and the lip 334 supports the tray 316 in the interior cavity 328 of the base container 314.

In one aspect of the present disclosure, the axial distance between the rim 422 and the base 402 of the tray 416 is less than the axial distance between the lip 334 and the base wall 320 of the base container 314. In this example, the base 402 of the tray 316 is axially displaced from the base wall 320 of the base container 314 when the rim 422 of the tray 316 is engaged with the lip 334 of the base container 314. The axial displacement of the base 402 of the tray 316 and the base wall 320 forms a gap 428 (shown in FIG. 28) between the base 402 and the base wall 320.

Referring now to FIGS. 40-43, the cover 318 is shown. The cover 318 includes a passage portion 502 and a brim portion 504. In one aspect of the present disclosure, the passage portion 502 is centrally disposed on the cover 318 and includes an outer portion 506 and a convex portion 508 disposed on a top surface 510 of the cover 318. The passage portion 502 defines a plurality of apertures 512 that extend through the cover 318. The plurality of apertures 512 is adapted to pass fluid during and/or after the food components within the base container 314 are heated. In one aspect of the present disclosure, the plurality of apertures 512 vents fluid vapor during heating. In another aspect of the present disclosure, the plurality of apertures 512 drains fluid after heating as the base container 314 is rotated toward an inverted position (see FIG. 25). In another aspect of the present disclosure, the plurality of apertures 512 strains the food components within the base container 314 as the base container 314 is in the inverted position. In this example, the plurality of apertures 512 is sized such that the food components within the interior cavity 328 of the base container 314 remain within the base container 314 during draining and/or straining.

In one aspect of the present disclosure, the plurality of apertures 512 define a total open area that is in the range of about 2.5% to 15% of an effective area of the cover 318, where the effective area of the cover 318 is the area of the cover 318 that is subjected to fluid (liquid, gas, vapor) that is within the base container during heating of the fluid or draining of the fluid. In another aspect of the present disclosure, the total open area is in the range of about 4% to about 8% of the effective area of the cover 318. In another aspect of the present disclosure, total open area is greater than about 2.5% of the effective area of the cover 318, greater than about 4% of the effective area of the cover 318, or greater than about 10% of the effective area of the cover 318.

In one aspect of the present disclosure, each of the plurality of apertures 512 is a hole having an inner diameter. By way of example only, the inner diameter of each of the plurality of apertures is in a range of about 1.5 mm to about 6.5 mm. In another aspect of the present disclosure, the number of apertures disposed on the cover 318 is at least 20, at least 25, at least 30, at least 45, at least 60, or at least 65.

The passage portion 502 includes a plurality of ribs 514 that radiate partially inward from the outer portion 506 of the passage portion 502 toward the center of the convex portion 508. In one aspect of the present disclosure, there are six ribs 514 symmetrically disposed about a first center axis 515 and a second center axis 516 that is generally perpendicular to the first center axis 515. The ribs 514 include an upper surface 517 that is generally planar. The upper surface 517 of the ribs 514 provides an attachment site for a label or tamper-evident wrapping. The ribs 514 further provide increased stability of the convex portion 508. In addition, the upper surface 517 of the ribs 514 provide a surface on which another multiple component packaging system 310 can be stored (see FIG. 44).

Figure 41:
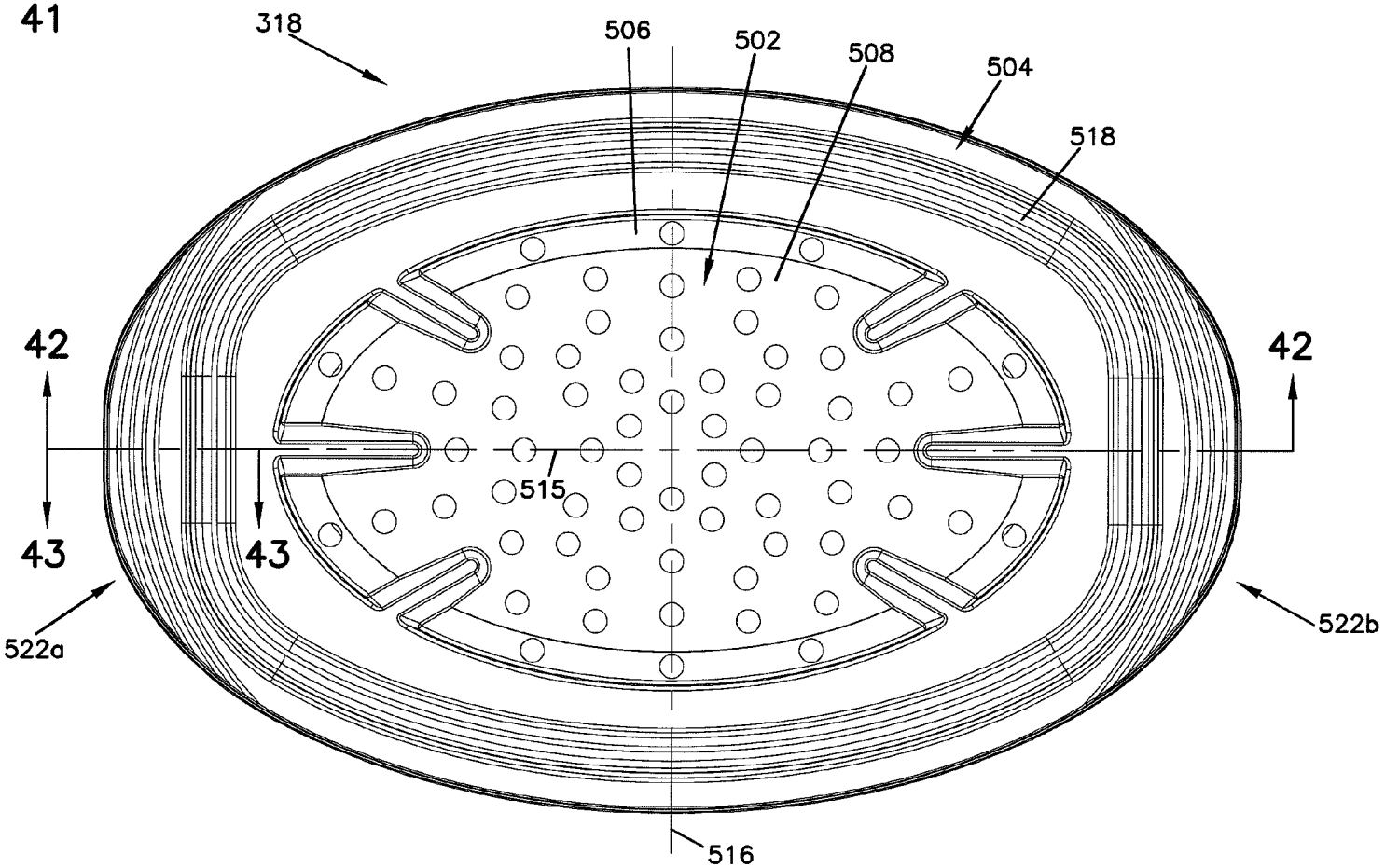
FIG. 41 is a top view of the cover of FIG. 40.
Figure 42:
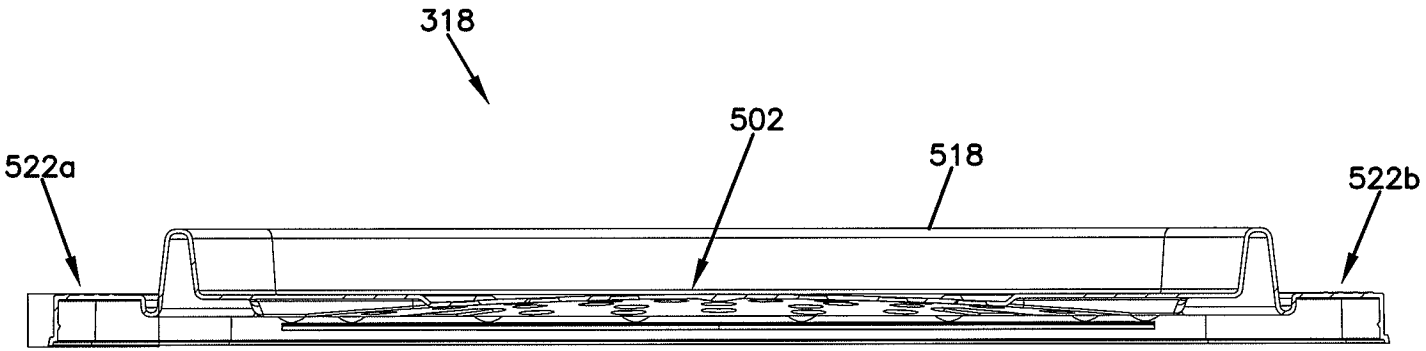
FIG. 42 is a cross-sectional view of the cover taken on line 42-42 of FIG. 41.
Figure 43:
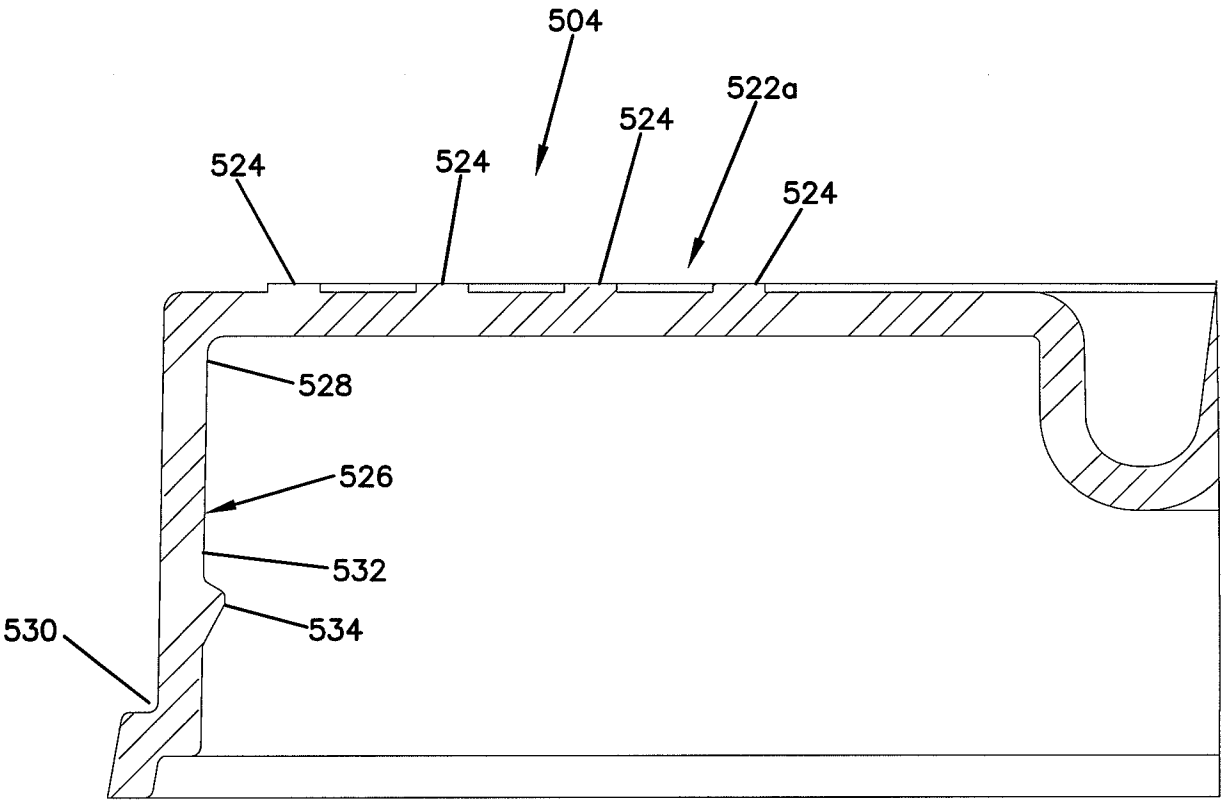
FIG. 43 is a cross-sectional view of a gripping portion of the cover taken on line 43-43 of FIG. 41.

Referring now to FIGS. 41 and 43, the brim portion 504 is disposed about an outer periphery of the cover 318. The brim portion 504 includes a first gripping portion 522*a* and an oppositely disposed second gripping portion 522*b*. The first and second gripping portions 522*a*, 522*b* include a plurality of elevations 524 that corrugate each of the first and second gripping portions 522*a*, 522*b*. In the depicted example, each of the plurality of elevations 524 is equally spaced from each adjacent elevation 524. The elevations 524 assist the consumer in grasping the first and second gripping portions 522*a*, 522*b* by providing a reduced-slip surface.

Figure 40:
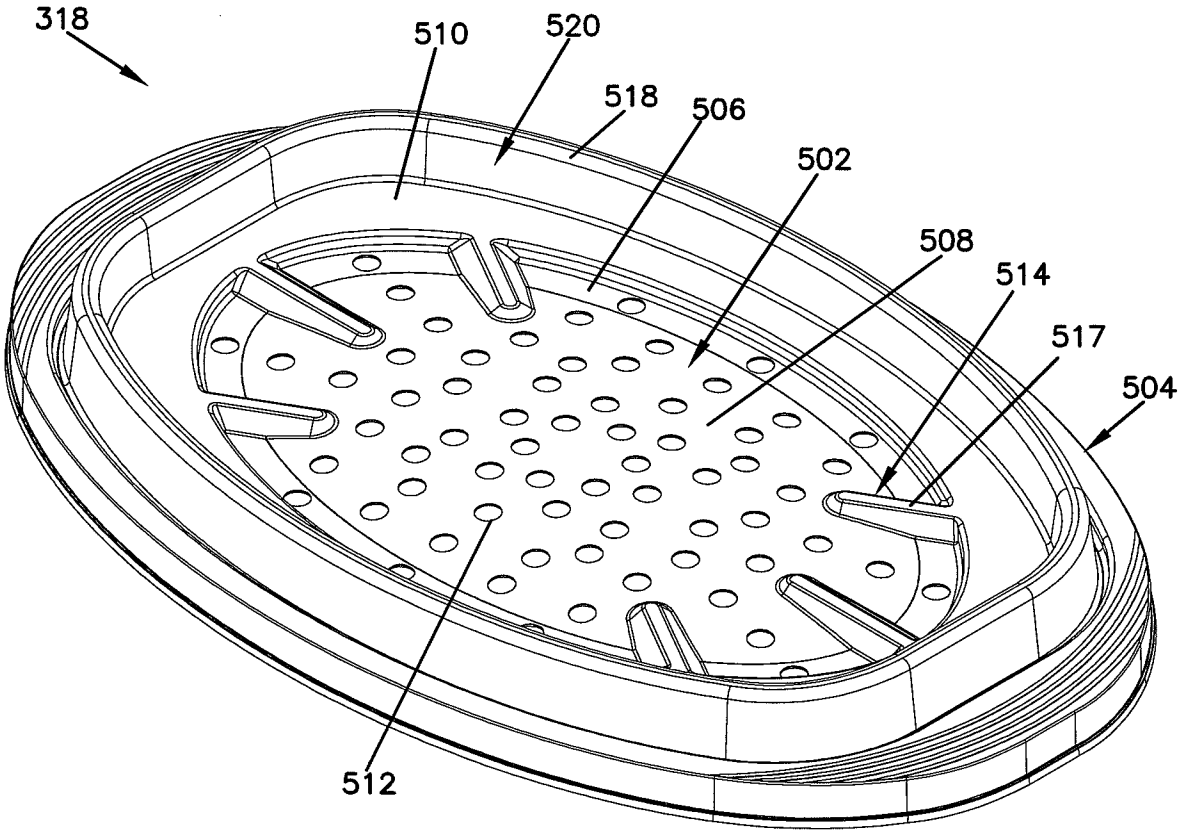
FIG. 40 is a perspective view of a cover suitable for use with the multi-component packaging system of FIG. 29.
Figure 44:
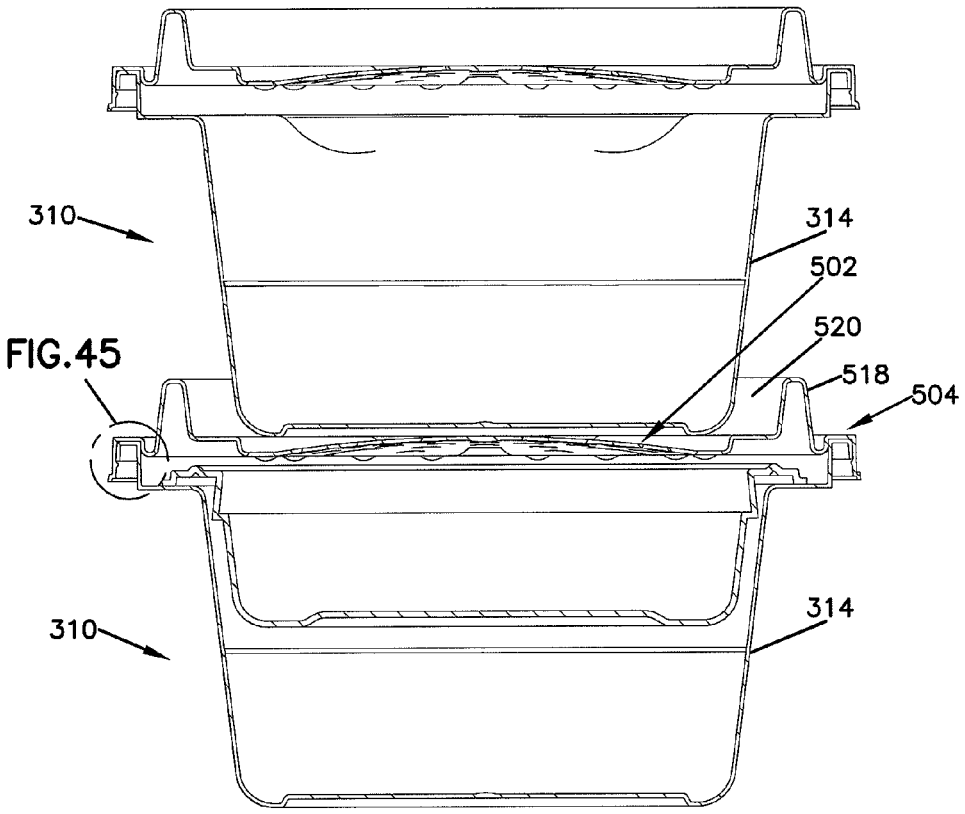
FIG. 44 is a cross-sectional view of stacking arrangement of a plurality of multi-component packaging systems.

Referring now to FIGS. 40 and 44, the cover 318 further includes a containment wall 518. The containment wall 518 is disposed between the passage portion 502 and the brim portion 504 of the cover 318. The containment wall 518 extends upwardly from the top of the cover 318 and is continuous around the cover 318. The containment wall 518 defines an inner cavity 520. The inner cavity 520 defines an inner volume. In one aspect of the present disclosure, the inner volume of the inner cavity 520 is less than or equal to about 50% of the volume of the interior cavity 328. In another aspect of the present disclosure, the inner volume is in the range of about 10% to about 40% of the volume of the interior cavity 328. In another aspect of the present disclosure, the inner volume is in the range of about 12% to about 25% of the volume of the interior cavity 328. In another aspect of the present disclosure, the inner volume is greater than or equal to about 2.5% of the volume of the interior cavity 328, greater than or equal to about 5% of the volume of the interior cavity 328, greater than or equal to about 10% of the volume of the interior cavity 328, greater than or equal to about 15% of the volume of the interior cavity 328, greater than or equal to about 20% of the volume of the interior cavity 328, greater than or equal to about 25% of the volume of the interior cavity 328, greater than or equal to about 30% of the volume of the interior cavity 328, or greater than or equal to about 35% of the volume of the interior cavity 328.

In one aspect of the present disclosure, the inner cavity 520 of the containment wall 518 is adapted to receive the base container 314 of another multiple component packaging system 310 when multiple component packaging systems 310 are disposed in a stacked configuration. While the base container 314 of the adjacent multiple component packaging system 310 is not firmly retained in the inner cavity 520, the containment wall 518 prevents excess lateral movement of the adjacent base container 314 which would otherwise result in the adjacent base container 314 falling off the cover 318 if the containment wall 518 was not present.

Figure 45:
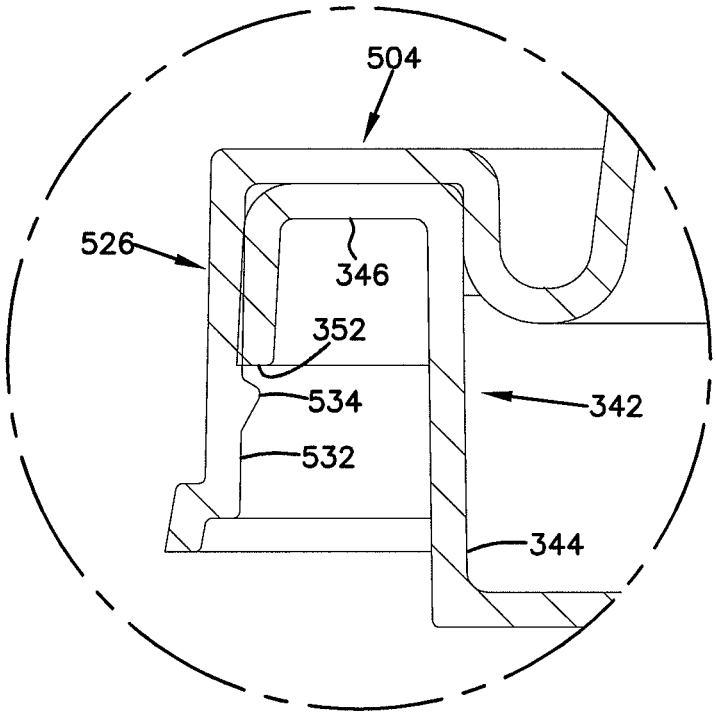
FIG. 45 is a cross-sectional view of an engaged cover and base container.

Referring now to FIGS. 43 and 45, the cover 318 further includes a collar 526 having a first end 528 and an oppositely disposed second end 530. The first end 528 of the collar 526 is connectedly engaged with the outer periphery of the brim portion 504 while the second end 530 of the collar 526 extends downwardly from a bottom surface of the brim portion 504. In one aspect of the present disclosure, the collar 526 is continuous or monolithic with the brim portion 504.

The collar 526 defines an inner surface 532 having a tab 534 protruding outwardly from the inner surface 532. The collar 526 is adapted to interlockingly engage the flange portion 332 of the base container 314. In one aspect of the present disclosure, the tab 534 is adapted to engage the edge 352 of the free end 344 of the rim portion 342 of the base container 314. The tab 534 is sized such that that the collar 526 flexes outwardly from the free end 346 of the rim portion 342 of the base container 314 as the cover 318 is initially engaged with the base container 314. When the tab 534 passes the edge 352 of the free end 345 of the base container 314, the collar 526 springs back. This springing back of the collar 526 after the tab 534 passes the edge 352 produces an audible clicking sound that alerts the consumer that the cover 318 is properly engaged with the base container 314.

Figure 46:
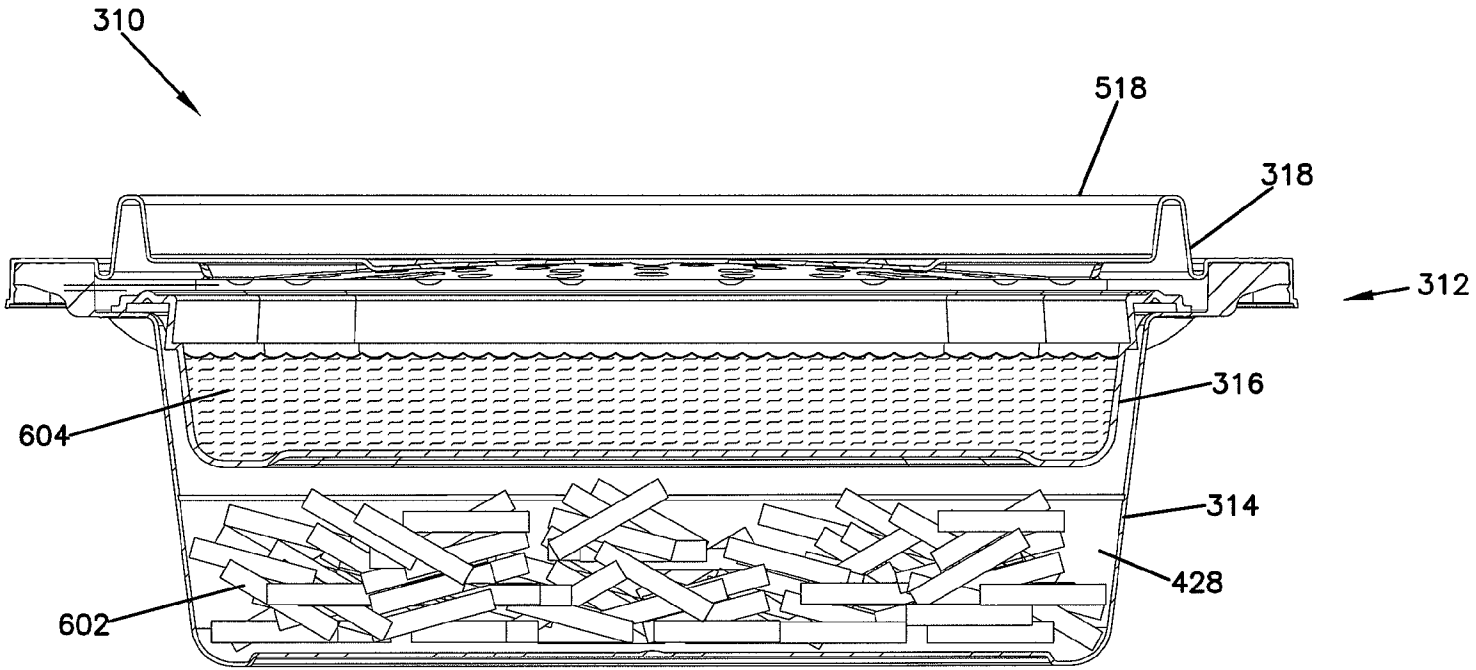
FIG. 46 is a cross-sectional view of the multi-component packaging system in which first and second food components are disposed.

Referring now to FIG. 46, the multiple component packaging system 310 is shown with food components disposed in the container assembly 312. In one aspect of the present disclosure, a first food component 602 is disposed in the base container 314 and a second food component 604 is disposed in the tray 316. In another aspect of the present disclosure, the first food component 602 is disposed in the gap 428 of the multiple component packaging system 310.

It is within the scope of the present disclosure for the first and second food components to include food components that are stored in a shelf-stable state, a refrigerated state, or a frozen state. In one aspect of the present disclosure, the first and second food components 602, 604 are shelf-stable food components. In another aspect of the present disclosure, the first and second food components 602, 604 are partial ingredients to a meal. For example, the first food component 602 could be a primary food component (e.g., starch-based component, protein-based component, vegetable-based component, combinations thereof, etc.) while the second food component 604 is a seasoning component (e.g., sauce, herbs, etc.).

In another aspect of the present disclosure, the first food component 602 disposed in the interior cavity 328 of the base container 314 is a starch-based and/or protein-based food component (e.g., pasta, rice, beans, etc.) that is dehydrated or partially dehydrated. A fluid (e.g., water, broth, etc.) is added to the base container 314 and used to hydrate the at least partially dehydrated food component. In order to properly hydrate the food component, the fluid is heated during a cooking process so that the fluid boils.

When a fluid such as water is used to cook starch-based food components, foam develops on the top surface of the fluid during boiling as a result of starches and proteins in the starch-based food component. As the foam continues to develop, the foam can flow over (i.e., boil-over) the edge of a microwavable container thereby creating a spill on a bottom surface of the microwave. While sidewalls of the microwavable container can be increased such that the foam will not flow over the edge of the microwavable container during cooking, such a design makes the portion of the food component disposed in the microwavable container look small, which could negatively affect the consumers desire to purchase the product.

In one aspect of the present disclosure, the container assembly 312 includes features that reduce or eliminate the risk of boil-over during cooking. In one example, the container assembly 312 includes a fluid volume containment feature and a surface tension breakage feature.

In order to reduce or eliminate boil-over and preserve an appropriate proportion between the amount of the first food component 602 disposed in the interior cavity 328 and the interior volume of the interior cavity 328 of the base container 314, the container assembly 312 includes the fluid volume containment feature, which allows fluid to be restrained above and below the cover 318 from flowing over an edge of the container assembly 312. As the fluid in the container assembly 312 boils, the foam generated by the starches and proteins in the starch-based food component 602 fills the interior cavity 328 of the base container 314. The foam passes through the plurality of apertures 512 in the cover 318 and is retained on the cover 318 by the containment wall 518, thereby preventing foam from flowing over the edge of the container assembly 312.

By containing fluid above the cover 318 in the inner volume of the containment wall 518, the volume of the base container 314 can be made smaller, which improves the perception of the amount or portion of the first food component 602 in the base container 314. However, even with the volume of the base container 314 reduced, the effective volume (containment volume above and below the cover 318) of the container assembly 312 can still reduce or eliminate the risk of boil-over.

The surface tension breakage feature of the container assembly 312 also reduces or eliminates the risk of boil-over. The residual starches in the starch-based food component increase the surface tension of the water in the base container 314. As a result of this increased surface tension, bubbles from the boiling water begin to accumulate and rise. The surface tension breakage feature disrupts the formation of bubbles. In one example, the surface tension breakage feature is a textured surface (e.g., ridges, bumps, etc.) that breaks the bubbles of the foam on contact. In one aspect of the present disclosure, the cover 318 includes the surface tension breakage feature on an interior surface 536 that faces the interior cavity 328 of the base container 314 when the cover 318 is disposed on the base container 314. In another aspect of the present disclosure, the cover 318 includes the surface tension breakage feature on the outer surface 510.

In one aspect of the present disclosure, the container assembly 312 includes a chemical agent that affects the formation of foam during the cooking process. In one aspect of the present disclosure, the chemical agent is applied to the first food component 602. In another aspect of the present disclosure, the chemical agent is applied to inner surfaces of the sidewalls 322 that face the interior cavity 328 of the base container 314. In another aspect of the present disclosure, the chemical agent is an ingredient of the first food component 602.

The chemical agent can be any one or combination of the following: oil (e.g., vegetable oil, nut oil, etc.); lecithin and lecithin modifications and derivatives; monoglycerides (e.g., acetylated monoglyceride, etc.), diglycerides, and triglycerides of various Fatty Acid sources, lengths, modifications (e.g., enzymatic, chemical, etc.) and derivatives (e.g., glycerin, etc.); and chemical or synthetic surfactants (e.g., silicon based antifoaming agents, etc.). It will be understood, however, that the scope of the present disclosure is not limited to the chemical agent being one of the above list.

In one aspect of the present disclosure, the base container 314 includes indicium 362 (shown in FIGS. 28-30) indicating the amount of fluid to add to the base container 314 prior to cooking.

In one example, the amount of fluid to be added to the base container 314 is proportional to the amount of the first food component 602 in the interior cavity 328 of the base container 314. In one example, the ratio of the amount of fluid added to the amount of first food component 602 in the base container 314 is in the range of about 2:1 to about 6:1. In one example, the amount of fluid added to base container 314 is the same regardless of the type (e.g., rice, pasta, etc.) of the at least partially dehydrated first food component 602 disposed in the interior cavity 328 of the base container 314.

In another example, in order to reduce or eliminate the risk of boil-over, the volume taken up by the amount of fluid and the amount of first food component 602 in the interior cavity 328 is less than or equal to about 60% of the total volume of the interior cavity 328 of the base container 314.

Figure 47:
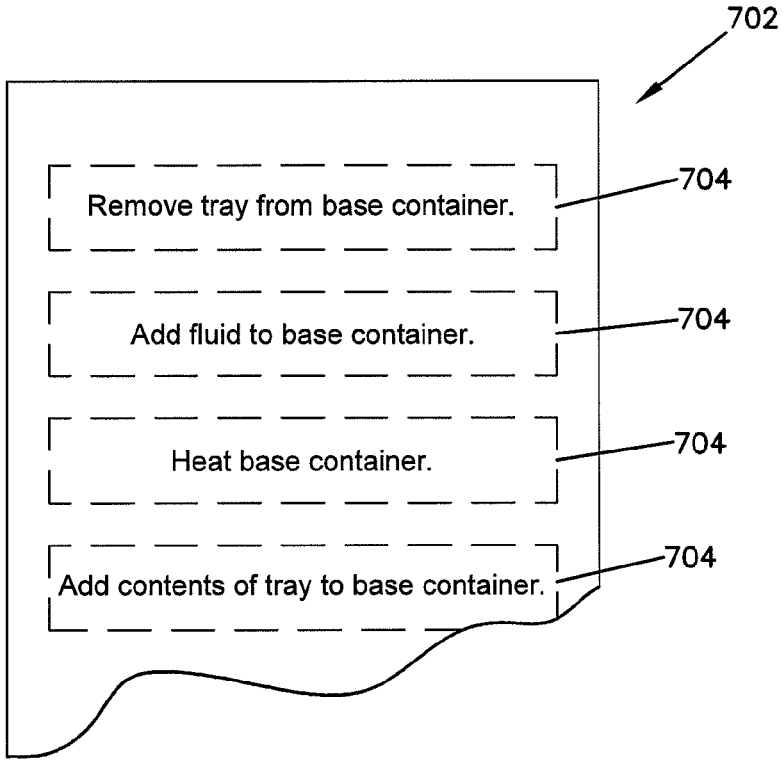
FIG. 47 is a representation of a set of instructions suitable for use with the multi-component packaging system of FIG. 27.

Referring now to FIGS. 46 and 47, in one aspect of the present disclosure, the multiple component packaging system 310 includes a set of instructions 702. The set of instructions 702 may be disposed on a label affixed to the base container 314, the cover 318, or the exterior packaging 200.

The set of instructions 702 include a plurality of steps 704 that instruct the consumer on how to prepare the first and second food components 602, 604. In one aspect of the present disclosure, the set of instructions 702 can include text, graphics, symbols, colors, etc.

In the example depicted in FIG. 47, the set of instructions 702 instruct the consumer to lift the tray 316 from the base container 314 and to add fluid (e.g., water, broth, etc.) to the base container 314. The set of instructions 702 then instruct the consumer to heat the contents of the base container 314 and to add the contents of the tray 316 to the base container 314.

Figure 48:
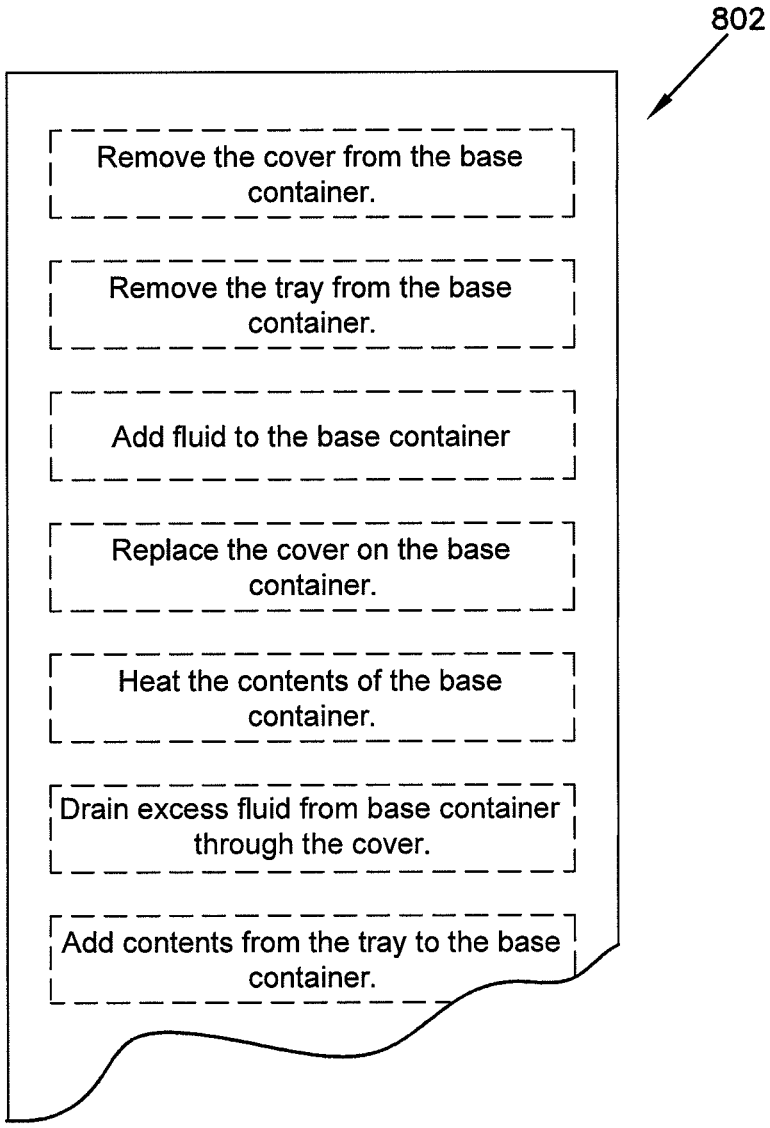
FIG. 48 is a representation of an alternate example of a set of instructions suitable for use with the multi-component packaging system of FIG. 27.

Referring now to FIG. 48, an alternate example of a set of instructions 802 suitable for use on the multiple component packaging system 310 is shown. In the depicted example, the set of instructions 802 instruct the consumer to remove the cover 318 from the base container 314 and lift the tray 316 from the base container 314. The set of instructions 802 then provide that fluid should be added to the base container 314 and the cover 318 reengaged to the base container 314. The set of instructions further instruct the consumer to heat the contents of the base container 314 and then drain the excess fluid through the plurality of apertures 512 in the cover 318. As the cover 318 includes the plurality of apertures 512, it will be understood that the cover 318 can be reengaged with the base container 314 at any point following removal of the tray 316 and prior to draining of the excess fluid through the cover 318. The set of instructions further instruct adding the contents of the tray 316 to the base container 314.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A microwavable container system comprising:

a base container defining an interior cavity having an interior volume, wherein the interior cavity includes a first food component and is adapted to receive a fluid; and a cover selectively engaged with the base container, the cover including:

a top surface, the top surface having a brim portion, the brim portion being disposed about an outer periphery of the cover;

a bottom surface disposed opposite the top surface;

a passage portion being centrally disposed on the cover; and a wall extending upwardly from the top surface of the cover, the wall being spaced inwardly from the brim portion and being disposed about at least a portion of the passage portion, wherein the cover further includes a surface tension breakage feature for disrupting the surface tension of the fluid in the interior cavity of the base container during cooking, the surface tension breakage feature being a plurality of ridges disposed on the bottom surface of the cover, the bottom surface facing the interior cavity of the base container when the cover is engaged to the base container.

2. A microwavable container assembly as claimed in claim 1, wherein the inner volume of the containment wall of the cover is in the range of about 10% to about 40% of the interior volume of the base container.

3. A microwavable container assembly as claimed in claim 1, wherein the first food component is disposed in the interior cavity of the base container and includes a chemical boil-out agent applied to the first food component.

4. A microwavable container assembly as claimed in claim 3, wherein the chemical boil-out agent is acetylated monoglyceride.

5. A microwavable container assembly as claimed in claim 1, further comprising a tray disposed within the interior cavity of the base container, wherein the tray is adapted to receive a second food component.

6. A microwavable container assembly as claimed in claim 1, wherein the surface tension breakage feature is a plurality of apertures.

7. A microwavable container assembly as claimed in claim 6, wherein the plurality of apertures defines an open area that is greater than or equal to 2.5% of an effective area of the cover.

8. A microwavable container assembly as claimed in claim 1, wherein a chemical boil-out agent is applied to inner surfaces of sidewalls facing the interior cavity of the base container.

9. A microwavable container assembly as claimed in claim 1, wherein the first food component includes a chemical boil-out agent as an ingredient of the first food component.

10. A microwavable container assembly as claimed in claim 1, wherein the first food component is at least partially dehydrated.

11. A microwavable container assembly as claimed in claim 10, wherein the first food component is a starch-based component.

12. A cover for a microwavable container comprising:

a top surface having a brim portion, the brim portion being disposed about an outer periphery of the cover;

a bottom surface oppositely disposed from the top surface, wherein the bottom surface is adapted for engagement with a base container; and at least one wall extending upwardly from the top surface, the wall at a peripheral of a cavity having a plurality of fluid passages, the plurality of fluid passages being centrally disposed on the cover, wherein the cavity defines a volume that is adapted to retain fluid that passes through the plurality of fluid passages during heating, the brim portion being spaced outwardly from the wall.

* * * * *